United States Patent [19]

Hirano et al.

[11] Patent Number: 4,576,910

[45] Date of Patent: Mar. 18, 1986

[54] SILVER HALIDE COLOR LIGHT-SENSITIVE MATERIAL CONTAINING MAGENTA COLOR IMAGE-FORMING POLYMER OR COPOLYMER COUPLER LATEX

[75] Inventors: Tsumoru Hirano; Nobuo Furutachi, both of Kanagawa, Japan

[73] Assignee: Fuji Photo Film Co., Ltd., Kanagawa, Japan

[21] Appl. No.: 619,422

[22] Filed: Jun. 11, 1984

[30] Foreign Application Priority Data

Jun. 9, 1983 [JP] Japan ..... 58-103336
Aug. 8, 1983 [JP] Japan ..... 58-145331

[51] Int. Cl.[4] ..... G03C 1/08; G03C 7/16; G03C 7/26; G03C 7/32

[52] U.S. Cl. ..... 430/548; 430/381; 430/384; 430/386; 430/558

[58] Field of Search ..... 430/548, 558, 381, 386, 430/384

[56] References Cited

U.S. PATENT DOCUMENTS

| | | | |
|---|---|---|---|
| 3,647,452 | 3/1972 | Hendess et al. | 430/384 X |
| 3,725,067 | 4/1973 | Bailey et al. | 430/558 X |
| 4,388,404 | 6/1983 | Morigaki et al. | 430/548 |
| 4,409,320 | 10/1983 | Yagihara et al. | 430/548 X |
| 4,436,808 | 3/1984 | Yagihara et al. | 430/381 |
| 4,444,870 | 4/1984 | Hirano et al. | 430/381 |
| 4,455,363 | 6/1984 | Naito et al. | 430/548 X |
| 4,474,870 | 10/1984 | Yagihara et al. | 430/381 |

FOREIGN PATENT DOCUMENTS

| | | | |
|---|---|---|---|
| 0034950 | 9/1981 | European Pat. Off. | 430/386 |
| 1810463 | 10/1970 | Fed. Rep. of Germany | 430/558 |

*Primary Examiner*—John Kittle
*Assistant Examiner*—Mukund J. Shah
*Attorney, Agent, or Firm*—Sughrue, Mion, Zinn, Macpeak, and Seas

[57] ABSTRACT

A silver halide color photographic light-sensitive material containing in its silver halide emulsion layer a latex of magenta color image-forming polymer or copolymer coupler capable of coupling with an oxidation product of an aromatic primary amine developing agent, wherein said coupler has repeating units derived from the monomer represented by the formula (I), (II), (III), (IV) or (V)

(I)

(II)

(III)

(IV)

(V)

wherein $R_1$ represents a hydrogen atom, a lower alkyl group containing 1 to 4 carbon atoms or a chlorine atom, $R_2$, $R_3$ and $R_4$ each represents a hydrogen atom, (Abstract continued on next page.)

a hydroxy group, a substituted or unsubstituted alkyl group, a substituted or unsubstituted aryl group, a substituted or unsubstituted 5- or 6-membered hetero ring group, a substituted or unsubstituted alkylamino group, a substituted or unsubstituted acylamino group, a substituted or unsubstituted anilino group, a substituted or unsubstituted alkoxycarbonyl group, a substituted or unsubstituted alkylcarbonyl group, a substituted or unsubstituted arylcarbonyl group, a substituted or unsubstituted alkylthio group, a substituted or unsubstituted arylthio group, a substituted or unsubstituted carbamoyl group, a substituted or unsubstituted sulfamoyl group or a substituted or unsubstituted sulfonamido group, X represents a hydrogen atom, a halogen atom, or a coupling-off group linked through an oxygen atom, nitrogen atom or sulfur atom, A represents —NHCO—, —OCO— or a phenylene group, B represents alkylene (straight or branched), aralkylene or phenylene group or substituted group thereof, Y represents —O—, —NH—, —S—, —SO—, —$SO_2$—, —CONH—, —COO—, —NHCO— or —NHCONH—, and m represents 1 when n represents 1, or m represents 0 or 1 when n represents 0.

18 Claims, 1 Drawing Figure

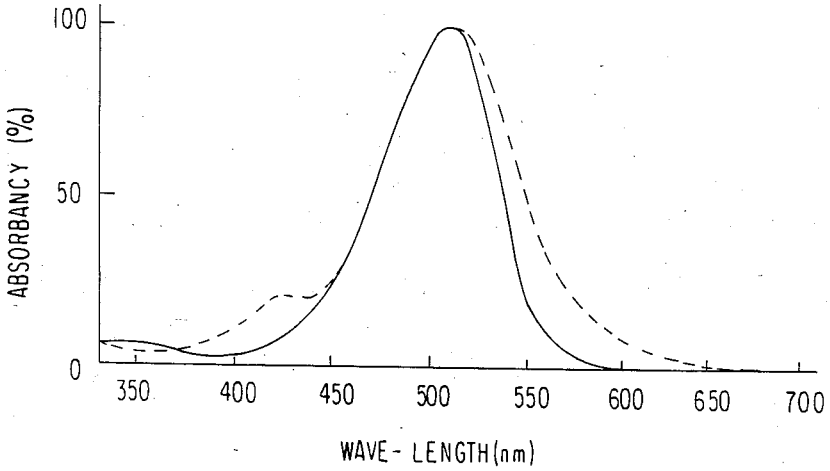
100
50
0
ABSORBANCY (%)
350
400
450
500
550
600
650
700
WAVE-LENGTH(nm)

SILVER HALIDE COLOR LIGHT-SENSITIVE MATERIAL CONTAINING MAGENTA COLOR IMAGE-FORMING POLYMER OR COPOLYMER COUPLER LATEX

FIELD OF THE INVENTION

This invention relates to a silver halide color photographic light-sensitive material containing a novel magenta color image-forming polymer capable of coupling with an oxidation product of an aromatic primary amine developing agent.

BACKGROUND OF THE INVENTION

It has been known that color development of an exposed silver halide color photographic material causes reaction between an oxidized aromatic primary amine development agent and a coupler to form a dye such as indophenol, indoaniline, indamine, azomethine, phenoxazine, phenazine or the like, thus a color image being formed. In this process, color reproduction is usually attained according to subtractive color photography using silver halide emulsions selectively responsive to blue, green and red light, together with agents capable of forming yellow, magenta and cyan color, are respectively in complementary relation with blue, green and red.

Yellow color images are formed by using, for example, acylacetanilide type or benzoylmethane type couplers, magenta color images are formed by using, primarily, pyrazolone type, pyrazolobenzimidazolone type, cyanoacetophenone type or indazolone type couplers, and cyan color images are formed by using, primarily, phenolic couplers such as phenols and naphthols.

Color couplers must meet various requirements; for example, they must possess good spectral characteristics and, upon color development, provide dye images having high stability to light, temperature, and humidity over a long period of time.

In multi-layered color light-sensitive materials, respective couplers must be immobilized in separate layers for the purpose of reducing color mixing and improving color reproduction. Many techniques are known for rendering couplers diffusion-resistant or non-diffusible.

One technique is to introduce a long-chain aliphatic group into a coupler molecule for preventing coupler diffusion. Couplers in accordance with this technique must be rendered alkali-soluble to add to a gelatin aqueous solution due to their immiscibility with water, or must be dissolved in a high-boiling organic solvent to emulsify and disperse in a gelatin aqueous solution.

Such color couplers can cause precipitation of crystals in an emulsion or, when a high-boiling organic solvent is used, require a large quantity of gelatin for softening the emulsion layer, resulting in an increase in thickness of the emulsion layer, which is contrary to the general desire of thinning emulsion layers.

Another technique of rendering couplers diffusion-resistant is to utilize a polymer coupler latex obtained by introducing a polymerizable group into coupler molecule and polymerizing the resulting coupler.

Examples of processes of adding a polymer coupler to a hydrophilic colloid composition in a latex form that have conventionally been known include a process of directly adding to a gelatino-silver halide emulsion a latex prepared by emulsion polymerization, and a process of dispersing an olephilic polymer coupler, obtained by polymerization of monomer coupler, in an aqueous gelatin solution as a latex. Examples of the former emulsion polymerization process include U.S. Pat. No. 3,370,952 which describes an emulsion polymerization process in aqueous gelatin, and U.S. Pat. No. 4,080,211 which describes an emulsion polymerization process in water. Examples of the latter process of dispersing an oleophilic polymer coupler as a latex are described in U.S. Pat. No. 3,451,820.

The process of adding a polymer coupler in latex form to a hydrophilic colloid composition has many merits over other processes.

First, since the hydrophobic material is in latex form, the material does not adversely affect the strength of membrane formed, and, since the latex can contain monomer coupler in a high concentration, the coupler can be easily incorporated in emulsion in a high concentration without a detrimental increase in viscosity.

In addition, it has a further merit that, due to the prevention of any transfer of the coupler, no color mixing and less precipitation of coupler in emulsion membrane take place.

Of such polymer couplers, magenta polymer couplers added in a latex form to gelatino-silver halide emulsion are exemplified by those described, for example, in U.S. Pat. Nos. 3,451,820, 3,926,436 and 4,080,211, British Pat. No. 1,247,688, West German Pat. No. 2,725,591, etc. In general, however, magenta color images formed by these conventionally known magenta polymer coupler latexes have the defect that their absorption wave form is broader than the color images formed by the analogous non-polymerized type magenta couplers, leading to deterioration of color reproducibility. Further, 5-pyrazolone type nuclei-containing magenta polymer coupler latexes that have so far been mainly studied show an desirable absorption of yellow component around 430 nm, which causes color stain.

U.S. Pat. No. 3,725,067 describes use of 1H-[5,1-c]-1,2,4-triazoles (not polymers) as magenta couplers. However, these magenta couplers have defects in that they have a small solubility in high-boiling organic solvents, and they show only a comparatively low coupling activity in ordinary developing solutions. Thus, in the case of adding necessary amounts of them to silver halide emulsions as an oil dispersion, the emulsion layers must be thickened, tending to lead to a deterioration of sharpness.

SUMMARY OF THE INVENTION

It is, therefore, an object of the present invention to provide a novel magenta color image-forming polymer coupler latex capable of forming magenta color images with a sharp absorption wave form and showing excellent color reproducibility.

Another object of the present invention is to provide a novel magenta color image-forming polymer coupler latex having excellent color-forming properties.

A further object of the present invention is to provide a novel magenta color image-forming polymer coupler latex having no unnecessary absorption of yellow component and causing no color stain.

A still further object of the present invention is to provide a color photographic light-sensitive material having a great membrane strength.

A still further object of the present invention is to provide a color photographic light-sensitive material having thin membranes, and therefore showing an improved sharpness.

The above-described objects of the present invention can be attained by incorporating in a silver halide emulsion a latex of magenta color image-forming polymer or copolymer coupler, wherein said coupler has pyrazolotriazole skeleton-containing repeating units derived from the monomer represented by formula (I), (II), (III), (IV) or (V).

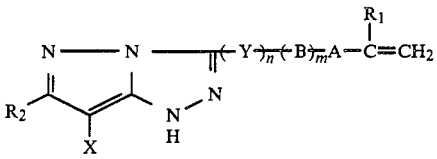

(I)

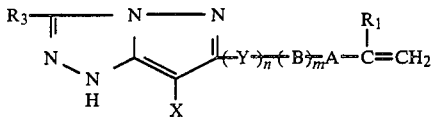

(II)

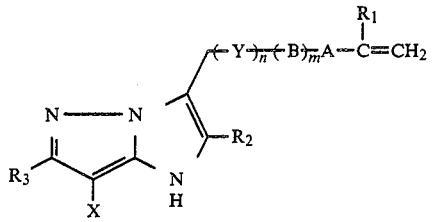

(III)

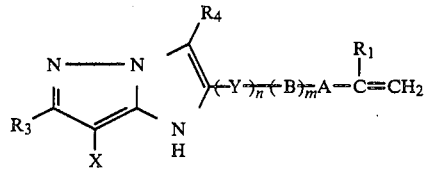

(IV)

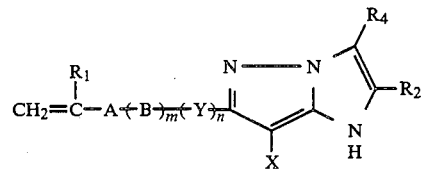

(V)

wherein $R_1$ represents a hydrogen atom, a lower alkyl group containing 1 to 4 carbon atoms, or a chlorine atom, $R_2$, $R_3$ and $R_4$ each represents a hydrogen atom, a hydroxy group, a substituted or unsubstituted alkyl group, a substituted or unsubstituted aryl group, a substituted or unsubstituted 5- or 6-membered hetero ring group, a substituted or unsubstituted alkylamino group, a substituted or unsubstituted acylamino group, a substituted or unsubstituted anilino group, a substituted or unsubstituted alkoxycarbonyl group, a substituted or unsubstituted alkylcarbonyl group, a substituted or unsubstituted arylcarbonyl group, a substituted or unsubstituted alkylthio group, a substituted or unsubstituted arylthio group, a substituted or unsubstituted carbamoyl group, a substituted or unsubstituted sulfamoyl group or a substituted or unsubstituted sulfonamido group, X represents a hydrogen atom, a halogen atom, or a coupling-off group linked through an oxygen atom, nitrogen atom or sulfur atom, A represents —NHCO—, —OCO— or a phenylene group, B represents alkylene (straight or branched), aralkylene or phenylene group or substituted group thereof, Y represents —O—, —NH—, —S—, —SO—, —$SO_2$—, —CONH—, —NHCO— or —NHCONH—, and m represents 1 when n is 1 or m represents 0 or 1 when n is 0.

BRIEF DESCRIPTION OF THE DRAWING

The FIGURE shows the visible absorption spectra obtained by forming color using a polymer coupler of the present invention (solid line) and comparative polymer coupler (a) (dashed line).

DETAILED DESCRIPTION OF THE INVENTION $R_2$, $R_3$, $R_4$, X and B in formulae (I) to (V) are described in detail below. $R_2$, $R_3$ and $R_4$ each represents a hydrogen atom, a hydroxy group, a substituted or unsubstituted alkyl group (preferably containing from 1 to 20 carbon atoms; for example, a methyl group, a propyl group, a t-butyl group, a trifluoromethyl group, a tridecyl group, etc.), a substituted or unsubstituted aryl group (preferably containing from 6 to 20 carbon atoms; for example, a phenyl group, a 4-tert-butylphenyl group, a 2,4-di-tert-amylphenyl group, a 4-methoxyphenyl group, etc.), a substituted or unsubstituted hetero ring group (for example, a 2-furyl group, a 2-thienyl group, a 2-pyrimidinyl group, a 2-benzothiazolyl group, etc.), a substituted or unsubstituted alkylamino group (preferably containing from 1 to 20 carbon atoms; for example, a methylamino group, a diethylamino group, a t-butylamino group, etc.), a substituted or unsubstituted acylamino group (preferably containing from 2 to 20 carbon atoms; for example, an acetylamino group, a propylamido group, a benzamido group, etc.), a substituted or unsubstituted anilino group (for example, a phenylamino group, a 2-chloroanilino group, etc.), a substituted or unsubstituted alkoxycarbonyl group (preferably containing from 2 to 20 carbon atoms; for example, a methoxycarbonyl group, a butoxycarbonyl group, a 2-ethylhexyloxycarbonyl group, etc.), a substituted or unsubstituted alkylcarbonyl group (preferably containing from 2 to 20 carbon atoms; for example, an acetyl group, a butylcarbonyl group, a cyclohexylcarbonyl group, etc.), a substituted or unsubstituted arylcarbonyl group (preferably containing from 7 to 20 carbon atoms; for example, a benzoyl group, a 4-tert-butylbenzoyl group, etc.), a substituted or unsubstituted alkylthio group (preferably containing from 1 to 20 carbon atoms; for example, a methylthio group, an octylthio group, a 2-phenoxyethylthio group, etc.), a substituted or unsubstituted arylthio group (preferably containing from 6 to 20 carbon atoms; for example, a phenylthio group, a 2-butoxy-5-tert-octylphenylthio group, etc.), a substituted or unsubstituted carbamoyl group (preferably containing from 1 to 20 carbon atoms; for example, an N-ethylcarbamoyl group, an N,N-dibutylcarbamoyl group, an N-methyl-N-butylcarbamoyl group, etc.), a substituted or unsubstituted sulfamoyl group (preferably containing up to 20 carbon atoms; for example, an N-ethylsulfamoyl group, an N,N-diethylsulfamoyl group, an N,N-dipropylsulfamoyl group, etc.), or a substituted or unsubstituted sulfonamido group (preferably containing from 1 to 20 carbon atoms; for example, a methanesulfonamido group, a benzenesulfonamido group, a p-toluenesulfonamido group, etc.).

X represents a hydrogen atom, a halogen atom (for example, a chlorine atom, a bromine atom, etc.), a coupling-off group linked through an oxygen atom (for example, an acetoxy group, a propanoyloxy group, a benzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 2-naphthoxy group, a 4-cyanophenoxy group, a 4-methanesulfonamidophenoxy group, a 2-naphthoxy group, a 3-pentadecylphenoxy group, a benzyloxycarbonyloxy group, an ethoxy group, a 2-cyanoethoxy group, a benzyloxy group, a 2-penethyloxy group, a 2-phenoxyethoxy group, a 5-phenyltetrazolyloxy group, a 2-benzothiazolyloxy group, etc.), a coupling-off group linked through a nitrogen atom (for example, those described in Japanese Patent Application No. 189538/82 corresponding to German Patent Application (OLS) No. 3,339,201, specifically a benzenesulfonamido group, an N-ethyltoluenesulfonylamido group, a heptafluorobutanamido group, a 2,3,4,5,6-pentafluorobenzamido group, an octansulfoamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2-oxo-1,2-dihydro-1-pyridinyl group, an imidazolyl group, a pyrazolyl group, a 3,5-diethyl-1,2,4-triazol-1-yl group, a 5- or 6-bromo-benzotriazol-1-yl group, a 5-methyl-1,2,3,4-triazol-1-yl group, a benzimidazolyl group, etc.), or a coupling-off group linked through a sulfur atom (for example, a phenylthio group, a 2-carboxyphenylthio group, a 2-methoxy-5-octylphenylthio group, a 4-methanesulfonylphenylthio group, a 4-octanesulfonamidophenylthio group, a benzylthio group, a 2-cyanoethylthio group, a 5-phenyl-2,3,4,5-tetrazolylthio group, a 2-benzothiazolyl group, etc.).

B represents an alkylene, aralkylene or phenylene group containing from 1 to 10 carbon atoms which is substituted or unsubstituted, with the alkylene group being either straight or branched. Examples of the alkylene group include a methylene group, a methylmethylene group, a dimethylmethylene group, a dimethylene group, a trimethylene group, a tetramethylene group, a pentamethylene group, a hexamethylene group, a decylmethylene group, etc., examples of the aralkylene group include a benzylidene group, etc., and examples of the phenylene group include p-phenylene group, m-phenylene group, methylphenylene group, etc.

Examples of substituents in the alkylene group, aralkylene group or phenylene group represented by B include an aryl group (e.g., a phenyl group, etc.), a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., a fluorine atom, a chlorine atom, a bromine atom, etc.), a carboxy group, a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), and the like. Where two or more substituents exist in B, they may be the same as, or different from, each other.

In the formulae (I), (II), (III), (IV) and (V) of the present invention, $R_1$ particularly preferably represents a hydrogen atom or a lower alkyl group (particularly a methyl group), $R_2$, $R_3$ and $R_4$ each particularly preferably represents a hydrogen atom, an alkyl group, or an aryl group, X particularly preferably represents a hydrogen atom, a halogen atom or a coupling-off group linked through a nitrogen atom, and, when n=1, Y particularly preferably represents —NHCO—, and, when m=1, B particularly preferably represents an unsubstituted alkylene, aralkylene, or phenylene group and A particularly preferably represents —NHCO—.

Preferable specific examples of the monomer couplers of the present invention represented by formulae (I) and (II) are illustrated below.

C-1

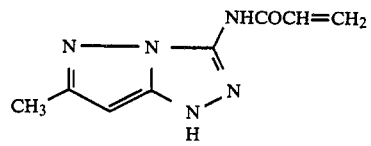

C-2

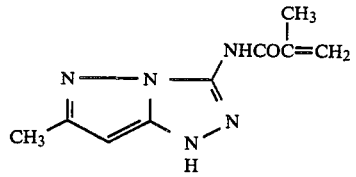

C-3

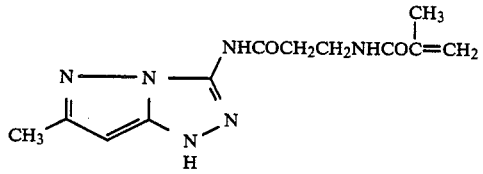

C-4

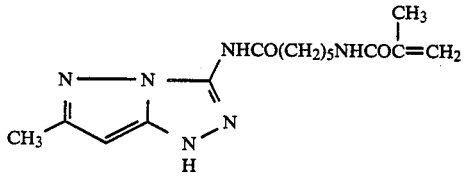

C-5

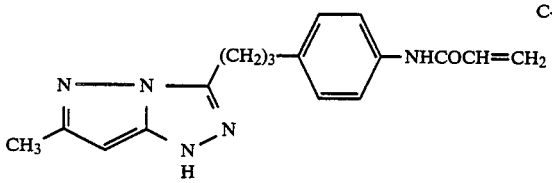

C-6

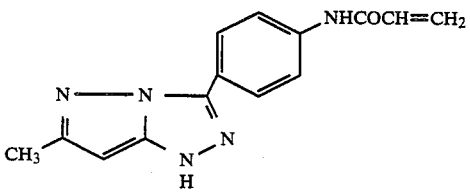

C-7

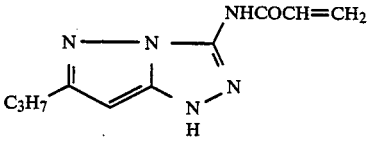

C-8

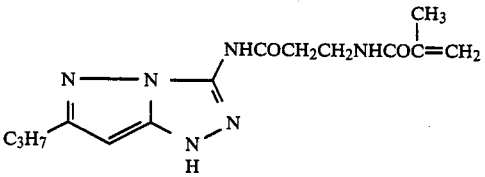

-continued
C-9
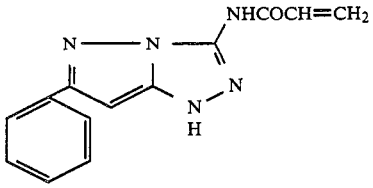
C-10
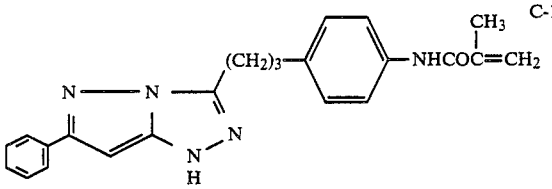
C-11
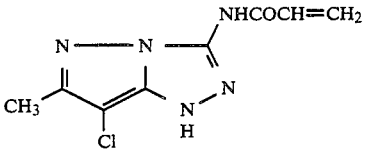
C-12
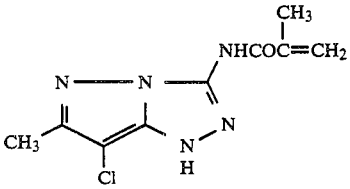
C-13
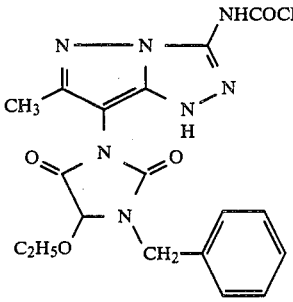
C-14
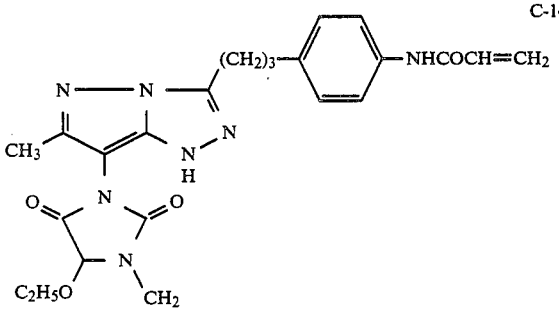
-continued
C-15
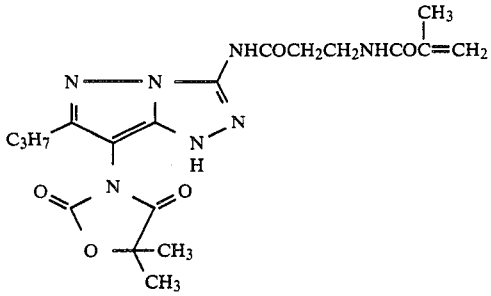
C-16
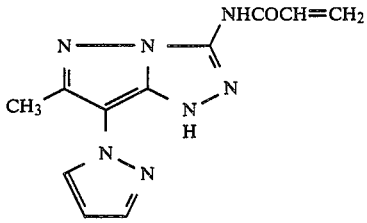
C-17
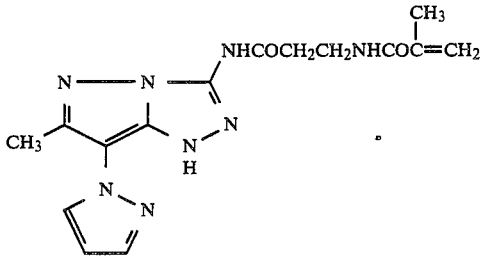
C-18
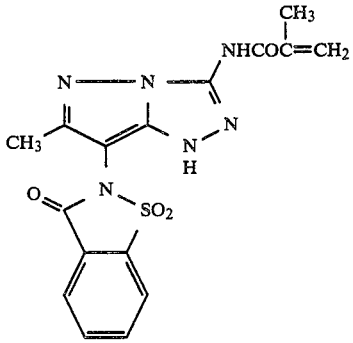
C-19
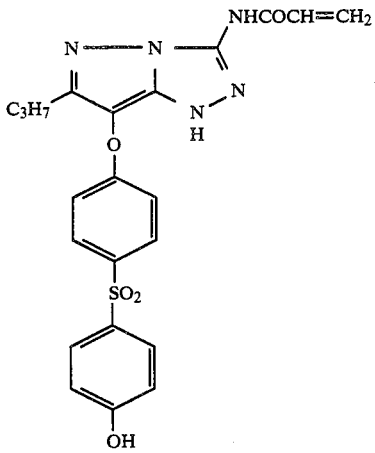

-continued
C-20
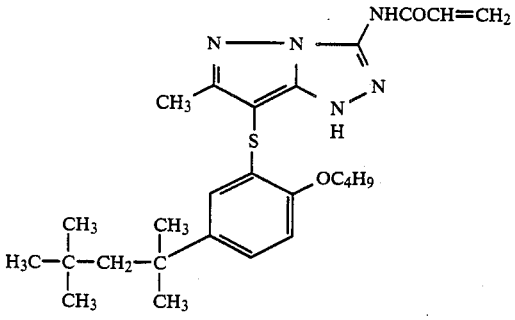
C-21
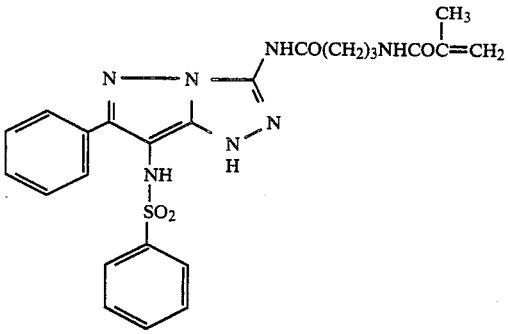
C-22
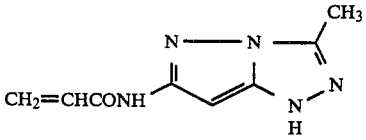
C-23
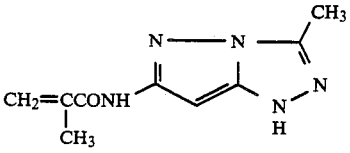
C-24
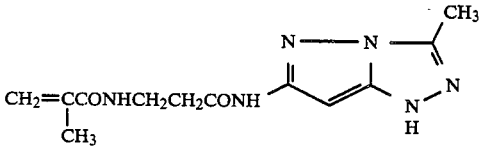
C-25
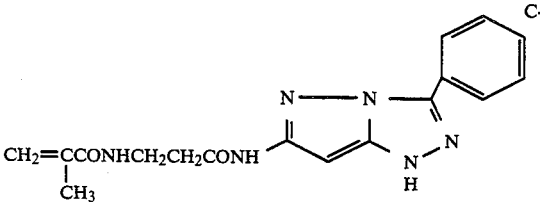
C-26
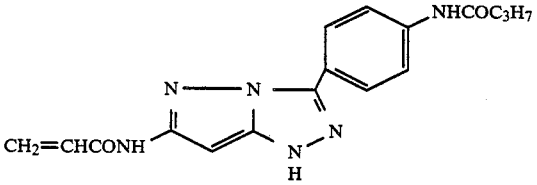
-continued
C-27
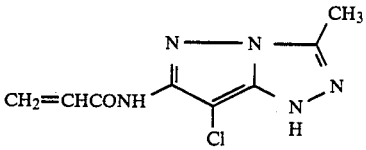
C-28
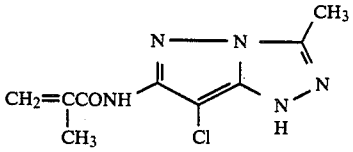
C-29
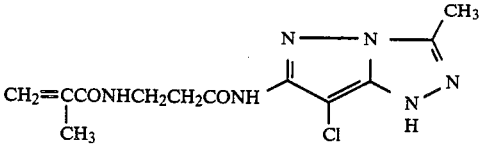
C-30
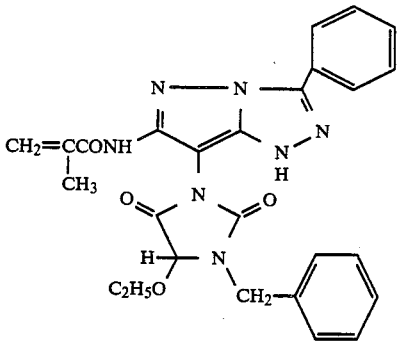
C-31
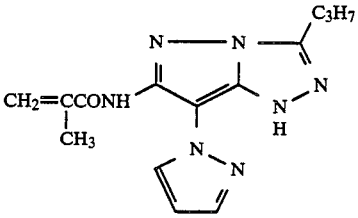
C-32
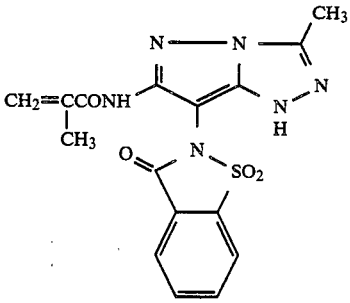
C-33
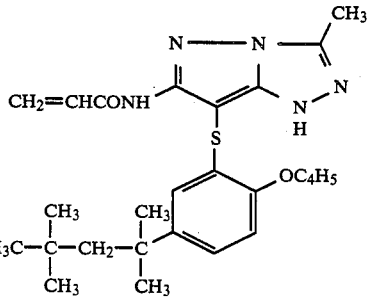

-continued

C-34

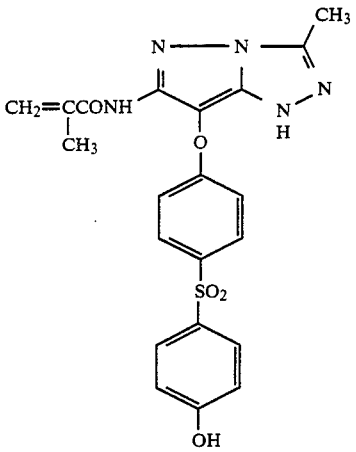

C-35

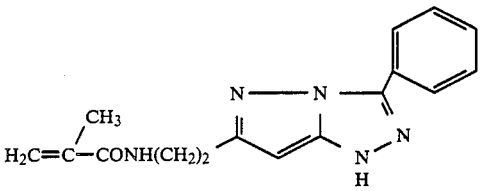

The monomer couplers described above and represented by formulae (I) and (II) can be generally synthesized by the reaction between an amine, having the following structural formula (A) or (B) which is obtained by the process described in U.S. Pat. No. 3,725,067, and an acid chloride having a vinyl group.

(A)

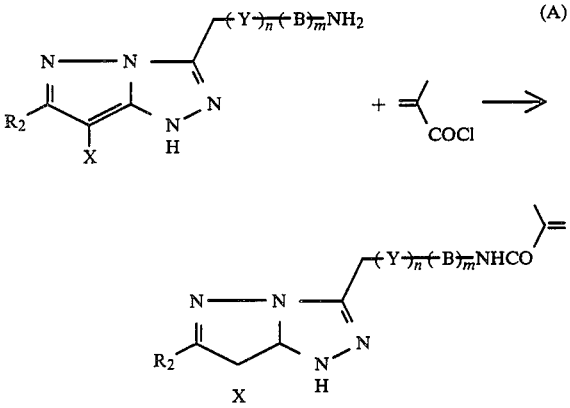

(B)

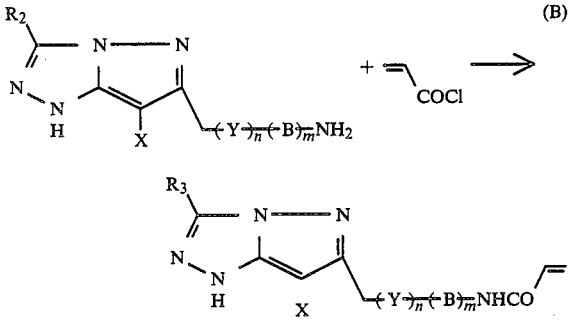

A synthesis example of the monomer couplers represented by formulae (I) and (II) are set forth below.

PREPARATION EXAMPLE 1

Synthesis of 3-[3-(3-acrylamidophenyl)-propyl]-6-methyl-1H-pyrazolo-[5,1-c]-1,2,4-triazole (C-5)

25.2 g (0.1 mol) of 3-[3-(3-aminophen yl)-propyl]-6-methyl-1H-pyrazolo[5,1-c]-1,2,4-triazole synthesized according to Preparation Example 9 described in Japanese Patent Application (OPI) No. 42045/83 corresponding to European Patent Application No. $0073636A_1$ was dissolved in a mixture of 200 ml of acetonitrile, 100 ml of dimethylacetamide, 16 ml of pyridine, and 1 ml of nitrobenzene. 9.5 g (0.105 mol) of acryl chloride was gradually added dropwise thereto, and, after reaction for one-hour at a temperature not higher than 10° C. with stirring, water and ethyl acetate were added thereto, followed by extracting procedure. The ethyl acetate phase was well washed with saturated sodium chloride aqueous solution, then the solvent was removed. The product was crystallized from acetonitrile. Recrystallization of the crude product from acetonitrile yielded 20.6 g of C-5 having m.p. of 195° to 197° C.

Elemental analysis: Calcd. for $C_{17}H_{19}N_5O$: C: 65.99%; H: 6.20%; N: 22.64%. Found: C: 65.78%; H: 6.23%; N: 22.52%.

PREPARATION EXAMPLE 2

Synthesis of 6-(2-methacrylamidoethyl)-3-phenyl-1-H-pyrazolo-[3,2-c]-1,2,4-triazole (C-35)

Reaction Scheme

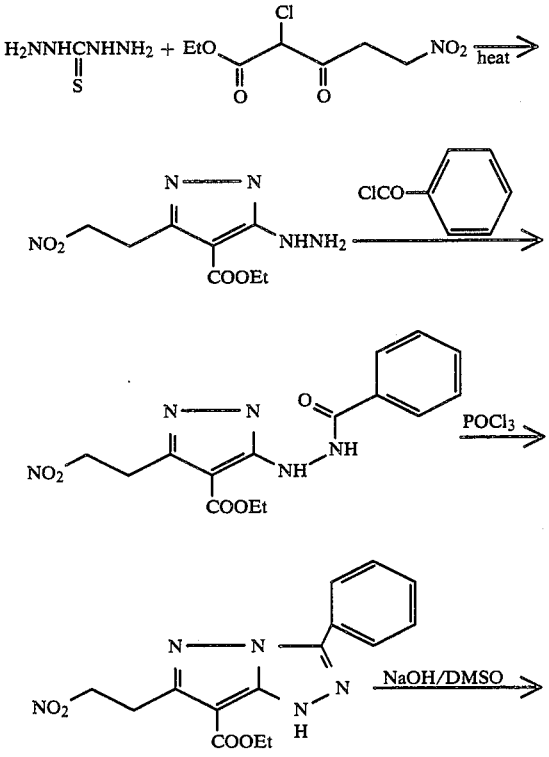

-continued

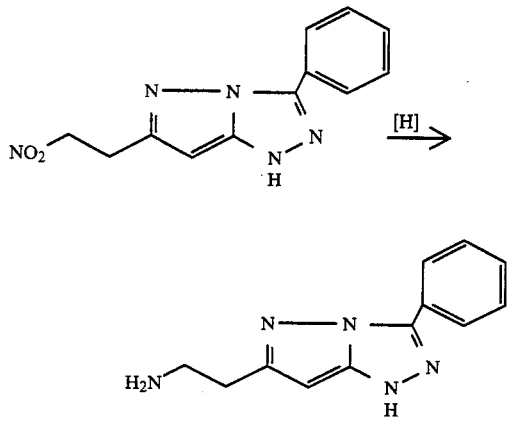

22.7 g (0.1 mol) of the amination product obtained according to the above reaction scheme was dissolved in a mixture of 250 ml of acetonitrile, 16 ml of pyridine and 1 ml of nitrobenzene, 9.5 g (0.105 mol) of methacrylic acid chloride was gradually added dropwise thereto, and, after reaction for one-hour at a temperature not higher than 10° C. with stirring, water and ethylacetate were added thereto, followed by extracting procedure. The ethyl acetate phase was dried and then, the solvent was removed. The product was crystallized from acetonitrile. Recrystallization of the crude product from acetonitrile yielded 18.9 g of white crystal of C-35.

Elemental analysis: Calcd. for $C_{16}H_{17}N_5O$: C: 65.06%; H: 5.81%; N: 23.71%. Found: C: 65.13%; H: 5.86%; N: 23.62%.

Preferable specific examples of the monomer couplers of the present invention represented by formulae (III), (IV) and (V) are illustrated below.

Cp-1

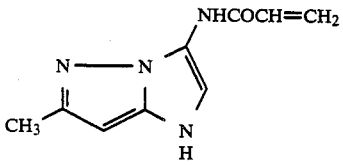

Cp-2

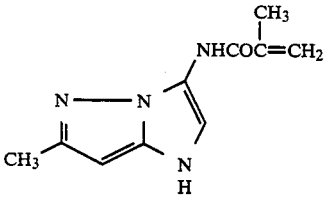

Cp-3

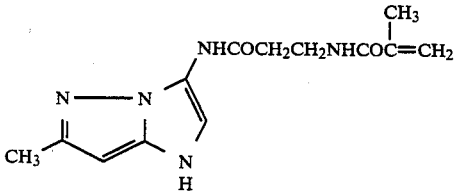

-continued

Cp-4

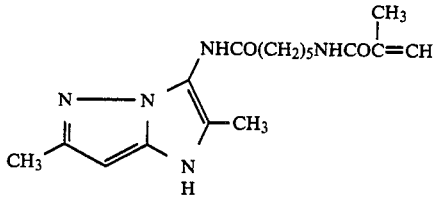

Cp-5

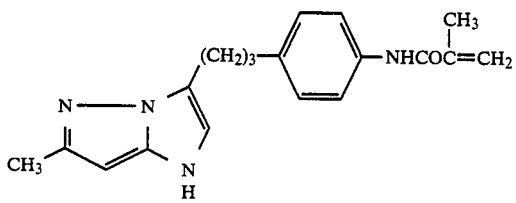

Cp-6

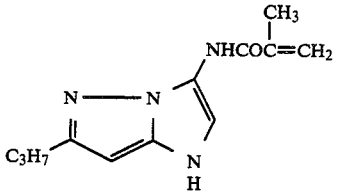

Cp-7

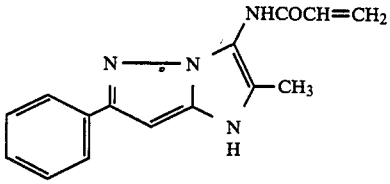

Cp-8

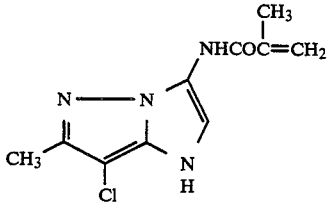

Cp-9

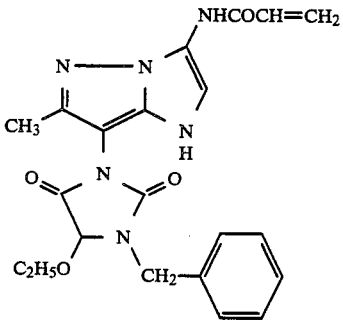

Cp-10

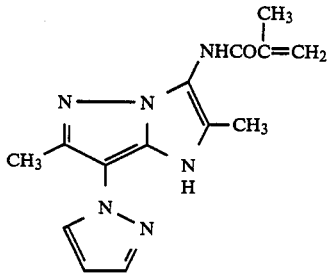

-continued
Cp-11
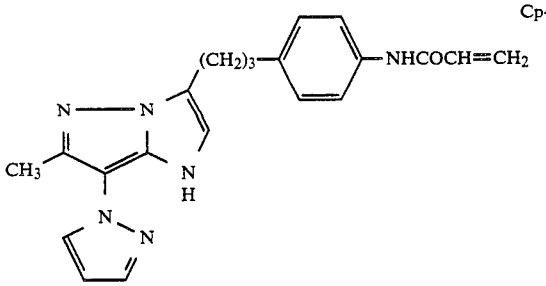
Cp-12
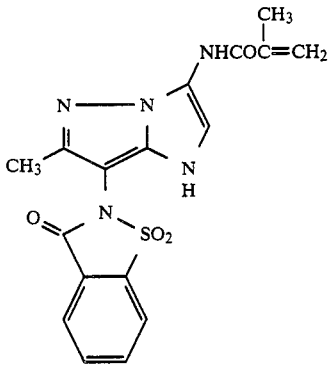
Cp-13
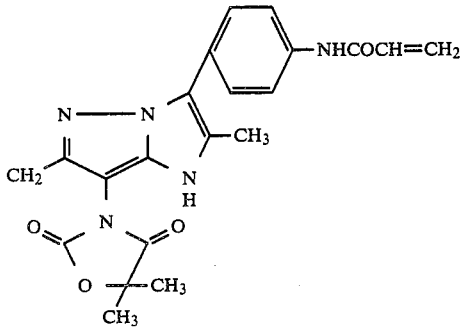
Cp-14
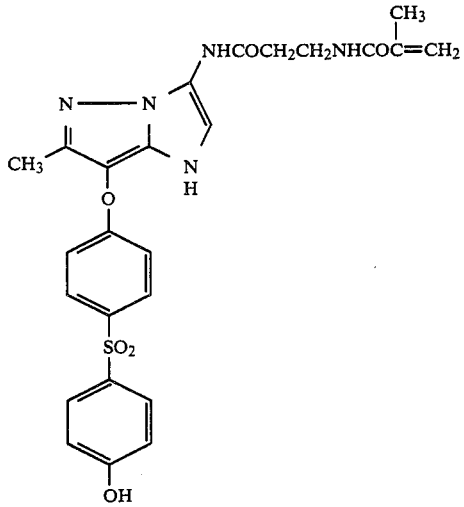
-continued
Cp-15
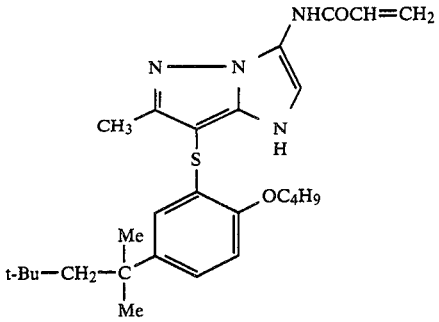
Cp-16
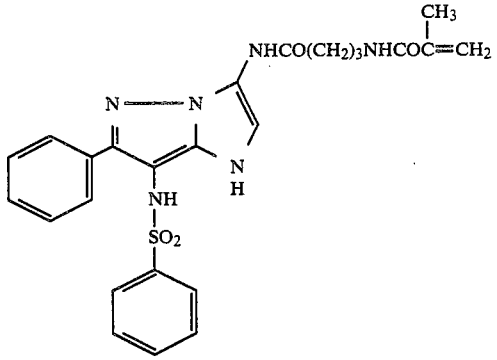
Cp-17
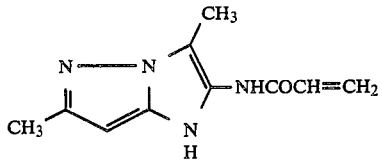
Cp-18
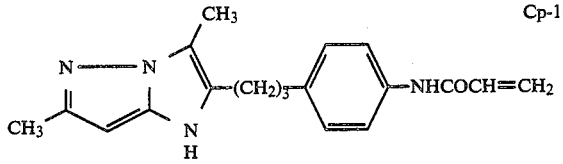
Cp-19
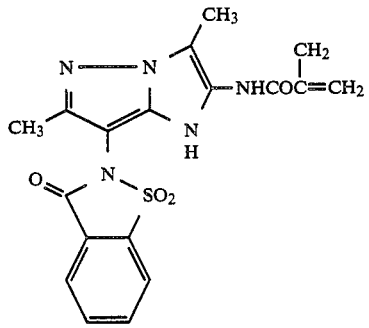
Cp-20
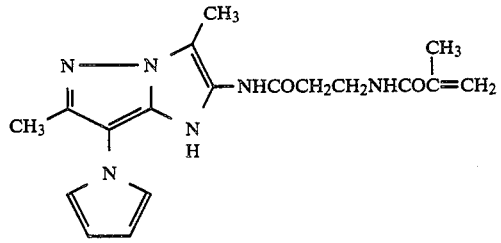

-continued
Cp-21
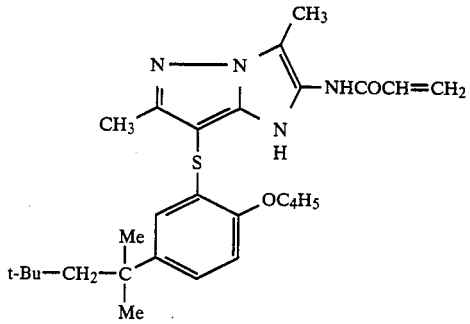
Cp-22
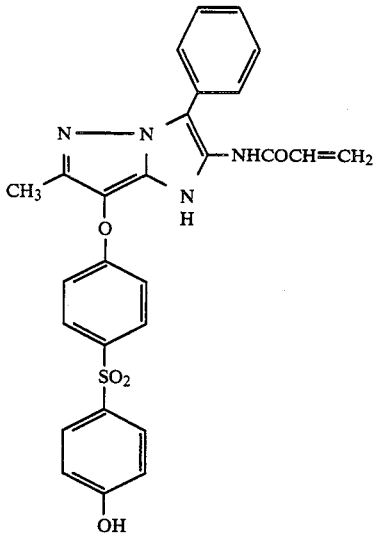
Cp-23
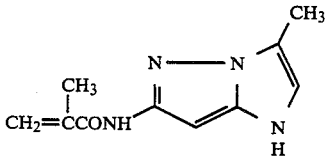
Cp-24
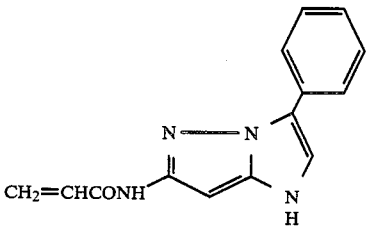
Cp-25
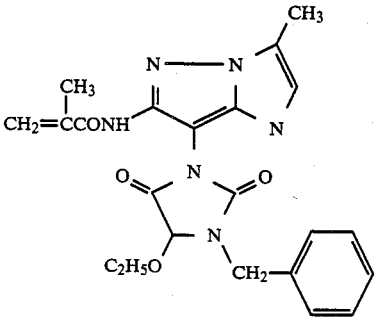
-continued
Cp-26
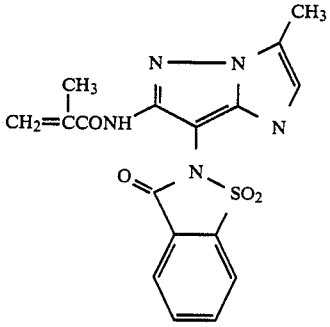
Cp-27
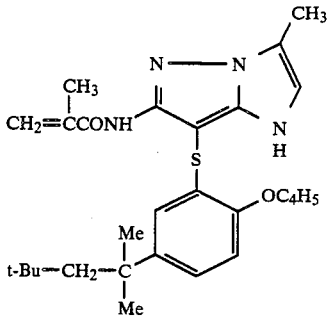
Cp-28
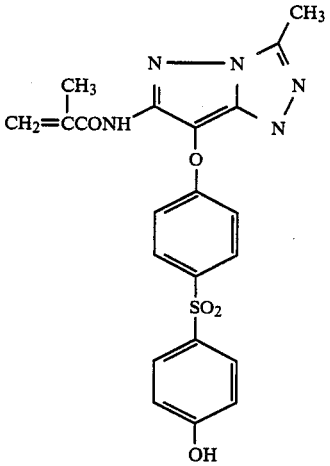
Cp-29
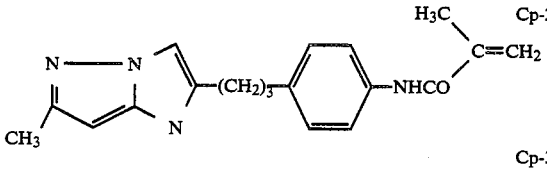
Cp-30
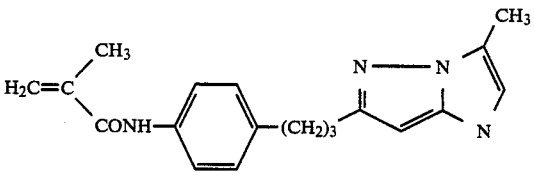
The monomer couplers of the general formulae (III), (IV) and (V) above may be synthesized by a reaction of an amine derivative of an imidazopyrazole obtained by the process described in Japanese Patent Application No. 23434/83 or J. Heterocyclic Chem., Vol. 10, p. 411 (1973) with an acid chloride having a vinyl group.

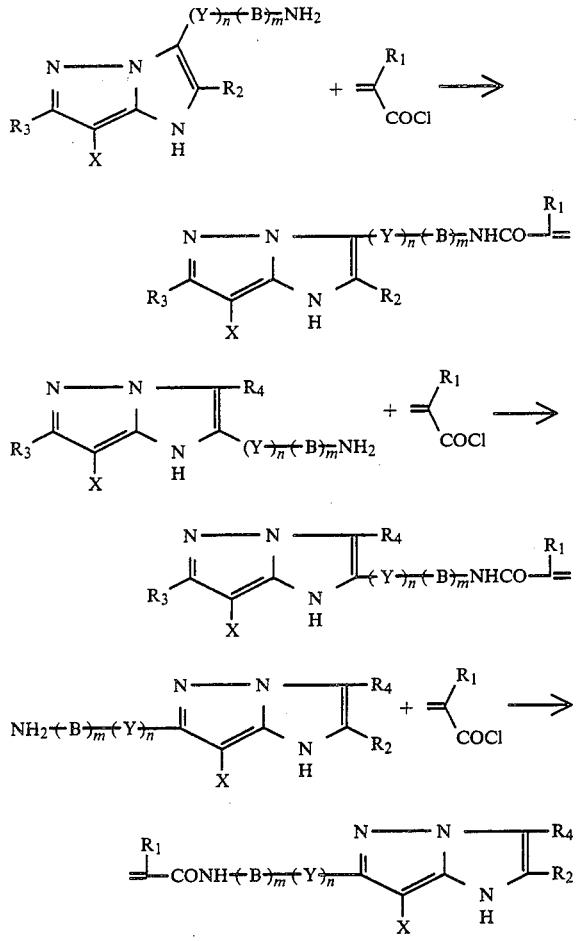

PREPARATION EXAMPLE 3

Synthesis of
6-methyl-3-[3-(3-methacrylamidophenyl)propyl]-1H-imidazo[1,2-b]-pyrazole ($C_p$-5)

Reaction Scheme

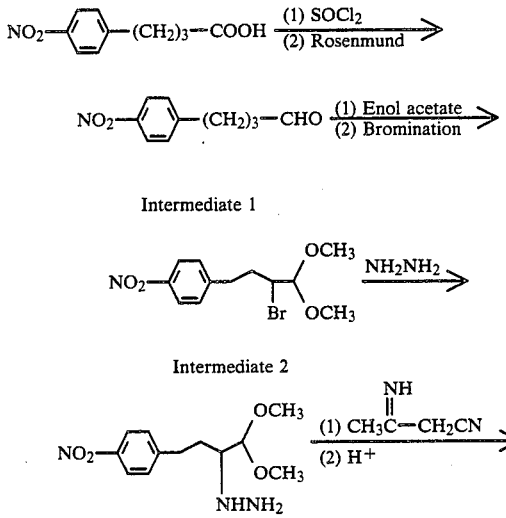

Intermediate 1

Intermediate 2

Intermediate 3

-continued

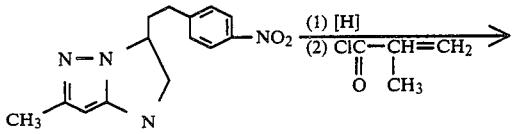

Intermediate 4

Compound ($C_p$-5)

(1) Synthesis of Intermediate 4

4-(4-Nitrophenyl)butyric acid, as a starting material, was converted to the acid chloride using thionyl chloride acid then subjected to Rosenmund reduction to obtain 4-(4-nitrophenyl)butyral (intermediate 1).

87 g of Intermediate 1, 122 g of acetic anhydride and 9.8 g of powdered potassium acetate were mixed, heated at an oil bath temperature of 150° to 160° C. for 2 hours, cooled, then poured into ice-water, and stirred for 12 hours.

The formed oil was filtered off, and then dissolved in 100 ml of carbon tetrachloride.

Bromine was gradually added dropwise thereto while stirring at room temperature. The color of bromine disappeared simultaneously with the dropwise addition while the bromination reaction still proceeded, and towards the end point of the reaction, just when the color did not disappear any longer, the addition was ceased (bromine, ca. 75 g). The reaction mixture was added to 300 ml of methanol, and allowed to stand at room temperature for 2 days. Thereafter, the solvent was removed, and the residue was separated by a silica gel flash column to obtain 80.5 g (yield 50.6%) of Intermediate 2 as an oil.

79.5 g of Intermediate 2 and 60 g of hydrazine anhydride were dissolved in 200 ml of absolute ethanol, and heated at reflux in a nitrogen stream for 15 hours. The solvent was removed, 500 ml of ether was added to the residue, further 100 g of potassium carbonate anhydride was added, and stirred at room temperature for 2 hours. Filtration and concentration of the filtrate yielded 53.8 g of Intermediate 3 as an oil.

Without purifying Intermediate 3, 53.8 g of Intermediate 3 and 18 g of 3-aminocrotononitrile were dissolved in 200 ml of ethanol, and heated at reflux in a nitrogen stream for 30 hours. Thereafter, 200 ml of ethanol was further added, 200 ml of 20% sulfuric acid was added, and heating at reflux was effected on an oil bath for 12 hours. After completion of the reaction, the reaction mixture was neutralized by adding solids of sodium bicarbonate in small portions while watching the reaction mixture carefully. This was filtered, then solids were washed with ethanol 3 times, and the washings and the filtrate were combined and concentrated to dryness. The inorganic matters and the placing point components were removed by passing through a short column to obtain 29.7 g of Intermediate 4 as a colorless powder.

(2) Synthesis of Compound ($C_p$-5)

27.0 g (0.1 mol) of Intermediate 4 was mixed in 250 ml of acetonitrile, 16 ml of pyridine and 1 ml of nitrobenzene. 9.5 g (0.105 mol) of methacryl chloride was gradually added dropwise thereto and, after a one-hour reaction with stirring at 10° C. or below, water and ethyl acetate were added followed by extracting procedure. The ethyl acetate phase was dried, then the solvent was removed, and the residue was recrystallized from acetonitrile to obtain 20.2 g of $C_p$-5.

Elemental analysis: Calcd. for $C_{19}H_{22}N_4O$: C: 70.78%, H: 6.88%; N: 17.38%. Found: C: 70.70%; H: 6.95%; N: 17.21%.

PREPARATION EXAMPLE 4

Synthesis of 3-methyl-6-[3-(3-methacrylamidophenyl)propyl]-1H-imidazo[1,2-b]-pyrazole (Cp-30)

Reaction Scheme

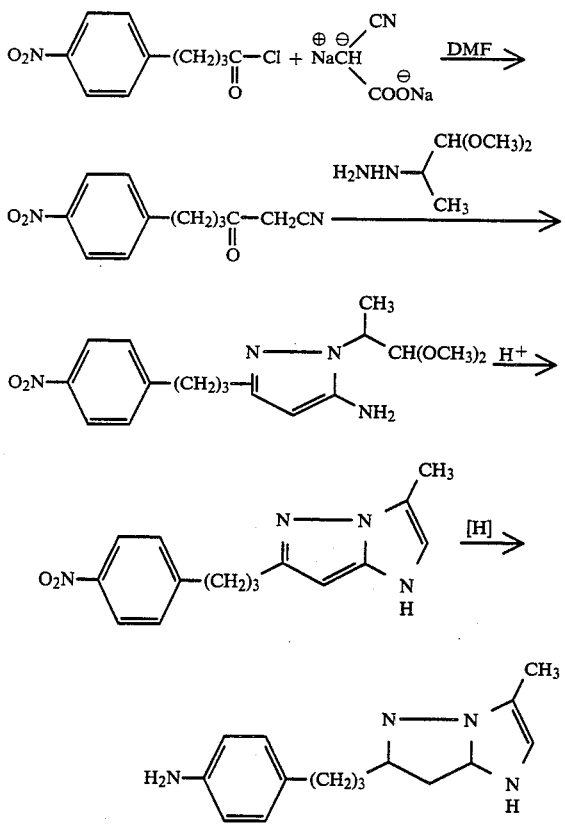

27.0 g (0.1 mol) of amination product obtained according to the above scheme was dissolved in a mixture of 250 ml of acetonitrile, 16 ml of pyridine and 1 ml of nitrobenzene. 9.5 g (0.105 mol) of methacrylic acid chloride was gradually added dropwise thereto, and after reaction for one-hour at a temperature not higher than 10° C. with stirring, water and ethylacetate were added thereto, followed by extracting procedure. The ethylacetate phase was dried and then, the solvent was removed. The product was crystallized from acetonitrile. Recrystallization of the crude product from acetonitrile yielded 21.8 g of Cp-30.

Elemental analysis: Calcd. for $C_{19}H_{22}N_4O$: C: 70.78%; H: 6.88%; N: 17.38%. Found: C: 70.85%; H: 6.92%; N: 17.31%.

PREPARATION EXAMPLE 5

Synthesis of 6-methyl-2-[3-(3-methacrylamido phenyl)propyl]-1H-imidazo[1,2-b]-pyrazole (Cp-29)

Reaction Scheme

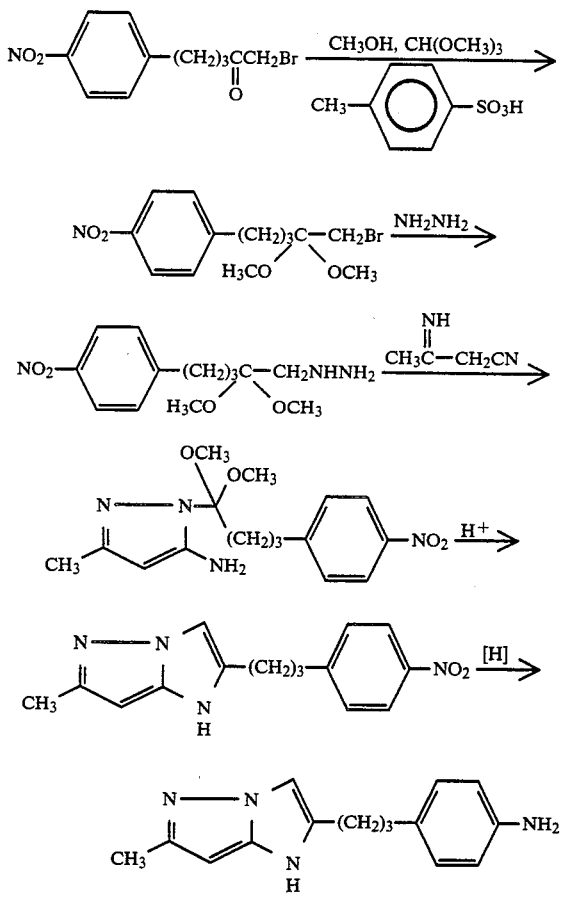

27.0 g (0.1 mol) of amination product was mixed in a mixture of 150 ml of acetonitrile and 1 ml of nitrobenzene and refluxed under heating. 9.5 g (0.105 mol) of methacrylic acid chloride was added dropwise thereto and after one-hour reaction followed by cooling water and ethylacetate were added and applied to extracting procedure. The ethylacetate phase was dried and then, the solvent was removed. The product was crystallized from acetonitrile. Recrystallization of the crude product from acetonitrile yielded 23.5 g of Cp-29.

Elemental analysis: Calcd. for $C_{19}H_{22}N_4O$: C: 70.78%; H: 6.88%; N: 17.38%. Found: C: 70.66%; H: 6.85%; N: 17.41%.

Other monomer couplers can be synthesized by analogy to the above-described process.

The polymer coupler of the present invention may be a homopolymer of the monomer coupler represented by formula (I), (II), (III), (IV) or (V), a copolymer between monomer couplers (I) to (V), or a copolymer between monomer coupler (I), (II), (III), (IV) and/or (V) and an ethylenically unsaturated monomer which does not couple with an oxidation product of an aromatic primary amine developing agent (and therefore forms no color). In any of these polymers, two or more monomer couplers included within formula (I) may be used as monomer coupler (I) and, likewise, two or more monomer couplers included within formula (II), (III), (IV) and (V) may be used as monomer coupler (II), (III), (IV) and (V), respectively.

Of the above-described polymers, copolymers between monomer coupler (I), (II), (III), (IV) or (V) and the aforesaid ethylenically unsaturated monomer forming no color are preferable.

The ethylenically unsaturated monomer not coupling with an oxidation product of an aromatic primary amine developing agent (therefore forming no color) includes acrylic acid, α-chloroacrylic acid, α-alacrylic acid (e.g., methacrylic acid, etc.), esters or amides derived therefrom (e.g., acrylamide, methacrylamide, n-butylacrylamide, t-butylacrylamide, diacetoneacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxymethacrylate), vinyl esters (e.g., vinyl acetate, vinyl propionate, and vinyl laurate), acrylonitrile, methacrylonitrile, aromatic vinyl compounds (e.g., styrene and its derivatives such as vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinylpyridine, and 2- and 4-vinylpyridine.

In particular, acrylic esters, methacrylic esters and maleic esters are preferable. Two or more of the ethylenically unsaturated monomers forming no color may be used in combination. For example, a combination of methyl acrylate and butyl acrylate, a combination of butyl acrylate and styrene, a combination of butyl methacrylate and methacrylic acid, a combination of methyl acrylate and diacetoneacrylamide, and the like can be used.

The ethylenically unsaturated monomer to be copolymerized with the monomer coupler of formula (I), (II), (III), (IV) or (V) can be so selected as to exert influences on physical and/or chemical properties of the resulting copolymer, such as solubility, compatibility with a binder in photographic colloid composition (for example, gelatin), flexibility, thermal stability, etc.

In view of this point, too, acrylic esters, methacrylic esters, and maleic esters are preferable comonomers.

The magenta polymer coupler latex to be used in the present invention may be prepared by emulsifying and dispersing an oleophilic polymer coupler, obtained by polymerizing the aforesaid monomer coupler or couplers and dissolved in an organic solvent, in an aqueous gelatin solution in latex form, or may be prepared directly according to emulsion polymerization.

As to the process of emulsifying and dispersing an oleophilic polymer coupler in a gelatin aqueous solution in latex form, techniques as described in U.S. Pat. No. 3,451,820 can be employed, and, as to the process of emulsion polymerization, techniques as described in U.S. Pat. Nos. 3,370,952 and 4,080,211 can be employed.

Synthesis of the magenta polymer coupler of the present invention can be conducted by using, as polymerization initiator and polymerization solvent, compounds which are described in Japanese Patent Application (OPI) Nos. 5543/81, 94752/82, 176038/82, 204038/82, 28745/83, 10738/83, 42044/83, 29683/82, etc. (the term "OPI" as used herein refers to a "published unexamined Japanese patent application").

Polymerization temperature must be selected in connection with molecular weight of the resulting polymer, the kind of initiator, etc. Temperatures between a temperature lower than 0° C. and 100° C. are employable. Usually, however, 30° C. to 100° C. are preferable for conducting the polymerization.

The proportion of color-forming moiety corresponding to formula (I), (II), (III), (IV) or (V) in the polymer coupler is preferably 5 to 80 wt%, with a proportion of 20 to 70 wt% being more preferable in view of color reproduction, color formation, and stability. In this case, the equivalent molecular weight (gram weight of polymer containing 1 mol of monomer coupler) is preferably in the range of from about 250 to about 4,000, although not being limited to this range.

Examples of preparing the polymers are described below.

(PROCESS I)

PREPARATION EXAMPLE 6

Copolymer coupler between 6-methyl-3-[3-(3-acrylamido)propyl]-1H-pyrazolo-[5-1-c]-1,2,4-triazole (C-5) and butyl acrylate (oleophilic polymer coupler I)

A mixture of 20 g of monomer coupler (C-5), 20 g of butyl acrylate, and 200 ml of dioxane was heated to 80° C. under stirring in a nitrogen stream, then 0.5 g of dimethyl azobisisobutyrate in 20 ml of dioxane was added thereto to initiate polymerization. After reacting for 5 hours, the reaction solution was cooled, and 1.5 l of water was added thereto. A solid thus precipitated was collected by filtration, then well washed with water, followed by heating under reduced pressure to dry. Thus, 38.9 g of oleophilic polymer (I) was obtained.

Nitrogen analysis of this polymer coupler revealed that it contained 50.2% of monomer coupler (C-5).

Then, a method of dispersing the oleophilic polymer coupler (I) in a gelatin aqueous solution in latex form will be described below. First, two solutions (a) and (b) were prepared as follows.

(a) 200 g of a 3.0 wt% aqueous solution of bone gelatin (pH 5.6 at 35° C.) was heated to 38° C., and 16 ml of a 10 wt% aqueous solution of sodium lauryl sulfate was added thereto.

(b) 20 g of the above-described oleophilic polymer coupler (I) was dissolved in 200 ml of ethyl acetate at 38° C.

Then, solution (b) was placed in an explosion-proof mixer under stirring at high speed, and solution (a) was rapidly added thereto. After one-minute stirring, the mixer was stopped, and ethyl acetate was distilled off under reduced pressure. Thus, the oleophilic polymer coupler was dispersed in a dilute gelatin solution to prepare latex (I').

PREPARATION EXAMPLE 7

Copolymer coupler of 3-methacrylamido-6-methyl-1H-pyrazolo-[5,1-c]-1,2,4-triazole (C-2), ethyl acrylate, and methacrylic acid (oleophilic polymer coupler (II))

A mixture of 20 g of monomer coupler (C-2), 10 g of ethyl acrylate, 5 g of methacrylic acid, and 200 ml of npropanol was heated to 80° C. under stirring in a nitrogen stream, then 0.3 g of dimethyl azobisisobutyrate in 20 ml of n-propanol was added thereto to initiate polymerization. After conducting the reaction for 5 hours, the reaction solution was cooled and poured into 1 liter of water. A solid thus precipitated was collected by filtration, and washed well with water. This solid was heated to dry under reduced pressure to obtain 32.5 g of oleophilic polymer (II).

Nitrogen analysis of this polymer coupler revealed that it contained 59.1% of monomer coupler C-2).

Then, a method of dispersing the oleophilic polymer coupler (II) in a gelatin aqueous solution in latex form will be described below. First, two solutions (a) and (b) were prepared as follows.

(a) 200 g of a 30 wt% aqueous solution of bone gelatin (pH 5.6 at 35° C.) was heated to 38° C., and 16 ml of a 10 wt% aqueous solution of sodium lauryl sulfate was added thereto.

(b) 20 g of the above-described oleophilic polymer coupler (II) was dissolved in 200 ml of ethyl acetate at 38° C.

Then, solution (b) was placed in an explosion-proof mixer under stirring at high speed, and solution (a) was rapidly added thereto. After one-minute of stirring, the mixer was stopped, and ethyl acetate was distilled off under reduced pressure. Thus, the oleophilic polymer coupler was dispersed in a dilute gelatin solution to prepare latex (II').

be described below. First, two solutions (a) and (b) were prepared as follows.

(a) 200 g of a 30 wt% aqueous solution of bone gelatin (pH 5.6 at 35° C.) was heated to 38° C., and 16 ml of a 10 wt% aqueous solution of sodium lauryl sulfate was added thereto.

(b) 20 g of the above-described oleophilic polymer coupler (III) was dissolved in 200 ml of ethyl acetate at 38° C.

Then, solution (b) was placed in an explosion-proof mixer under stirring at high speed, and solution (a) was rapidly added thereto. After one-minute of stirring, the mixer was stopped, and ethyl acetate was distilled off under reduced pressure. Thus, the oleophilic polymer coupler was dispersed in a diluate gelatin solution to prepare latex (III').

PREPARATION EXAMPLES 9 TO 24

The following oleophilic polymer couplers were prepared in an analogous manner as the copolymers obtained in Preparation Examples 2 to 4 (Process I)

| Oleophilic Polymer Couplers by Preparation Process I | | | | | | |
|---|---|---|---|---|---|---|
| Preparation Example | Oleophilic Polymer Coupler | Monomer (Kind) | Coupler (Amount) | Nonchromophoric Monomer (Kind) | Nonchromophoric Monomer (Amount) | Monomer Coupler Units in Polymer (wt %) |
| 9 | IV | C-1 | 20 g | BA | 20 g | 50.7 |
| 10 | V | C-2 | 20 g | BA | 20 g | 50.5 |
| 11 | VI | C-2 | 20 g | MA | 30 g | 43.2 |
| 12 | VII | C-3 | 20 g | BA | 20 g | 51.6 |
| 13 | VIII | C-13 | 20 g | BA | 15 g | 50.5 |
| | | | | MAA | 5 g | |
| 14 | IX | C-16 | 20 g | MA | 30 g | 42.8 |
| 15 | X | C-17 | 20 g | BA | 15 g | 60.1 |
| 16 | XI | C-18 | 20 g | 2-EHA | 20 g | 51.3 |
| 17 | XII | C-19 | 20 g | 2-EHA | 20 g | 50.9 |
| 18 | XIII | C-5 | 20 g | EA | 20 g | 52.0 |
| 19 | XIV | C-5 | 20 g | BA | 15 g | 59.8 |
| | | | | MAA | 5 g | |
| 20 | XV | C-22 | 20 g | 2-EHA | 20 g | 51.1 |
| 21 | XVI | C-23 | 20 g | MA | 20 g | 53.3 |
| 22 | XVII | C-25 | 20 g | BA | 10 g | 67.1 |
| 23 | XVIII | C-31 | 20 g | BA | 20 g | 50.5 |
| 24 | XIX | C-32 | 20 g | BA | 20 g | 50.9 |

Notes
MA: methyl acrylate; EA: ethyl acrylate; BA: butyl acrylate; 2-EHA: ethylhexyl acrylate; MAA: methacrylic acid
The amounts of the monomer coupler and the monomer forming no color are set forth based on the amounts charged upon synthesis.

PREPARATION EXAMPLE 8

Copolymer coupler between 7-{1,2-benzisothiazol-3(2H)-on-2-yl}-3-methacrylamido-6-methyl-1H-pyrazolo-[5,1-c]-1,2,4-triazole (C-18) and butyl acrylate (oleophilic polymer coupler (III))

A mixture of 20 g of monomer coupler (C-18), 20 g of butyl acrylate, and 200 ml of dioxane was heated to 80° C. in a nitrogen stream, and 0.4 mg of azobisisobutyronitrile in 20 ml of dioxane was added thereto to initiate polymerization. After reacting for 3 hours, the mixture was heated to 100° C. for further two hours. Then, the reaction solution was cooled, and poured into 2 liters of water. A solid thus precipitated was collected by filtration, then washed well with water.

This solid was heated to dry under reduced pressure to obtain 37.9 g of oleophilic polymer coupler (III).

Nitrogen analysis of this polymer coupler revealed that it contained 50.5% of monomer coupler (C-18).

A method of dispersing the oleophilic polymer coupler (III) in a gelatin aqueous solution in latex form will These oleophilic polymer couplers can also be dispersed in the same manner as with the foregoing Preparation Examples 1, to 8 to form latex.

(PROCESS II)

PREPARATION EXAMPLE 25

Copolymer coupler of 3-methacrylamido-6-methyl-1H-pyrazolo-[5,1-c]-1,2,4-triazole (C-2), butyl acrylate, and methyl acrylate (polymer latex coupler (A))

1.2 Liters of an aqueous solution containing 1 g of oleylmethyltauride was heated to 80° C. in a 3-liter flask with stirring while introducing a nitrogen stream thereinto. After adding 15 ml of a 2% aqueous solution of potassium persulfate thereto, a solution of 20 g of monomer coupler (C-2), 10 g of butyl acrylate, and 10 g of methyl acrylate in 500 ml of methanol prepared by heating was dropwise added thereto over a 20 minute period.

After reacting for one hour, 5 ml of a 2% aqueous solution of potassium persulfate was added thereto.

After reacting for one hour further, methanol and water were distilled off.

After cooling, the pH of the thus formed latex solution was adjusted to 6.0 with 1N sodium hydroxide, followed by filtration.

The latex had a polymer concentration of 5.0%. Nitrogen analysis of the polymer revealed that it contained 51.9% of monomer coupler (C-2).

PREPARATION EXAMPLE 26

Copolymer latex between 6-methyl-3-[3-(3-acrylamido)propyl]-1H-pyrazolo-[5,1-c]-1,2,4-triazole (C-5) and butyl acrylate (polymer latex coupler (B))

400 ml of an aqueous solution containing 2.2 g of oleylmethyltauride was heated to 80° C. in a 1-liter flask under stirring while introducing thereinto a nitrogen stream, and 2 ml of a 2% aqueous solution of potassium persulate and 4 g of butyl acrylate were added thereto. After one hour, 20 g of monomer coupler C-5, 10 g of butyl acrylate, and 200 ml of ethanol were added thereto, followed by further adding 20 ml of a 2% aqueous solution of potassium persulfate. After reacting for 2 hours, ethanol and unreacted butyl acrylate were distilled off.

The thus formed latex was cooled, and pH of the latex was adjusted to 6.0 with 1N sodium hydroxide, followed by filtration.

The resulting latex contained 9.6% of polymer, and nitrogen analysis thereof revealed that the polymer contained 57.1% of monomer coupler C-5.

PREPARATION EXAMPLES 27 TO 38

The following polymer coupler latexes were prepared in analogous manner as in Preparation Examples 25 and 26 (Process II).

Polymer Coupler Latexes by Preparation Process II

| Preparation Example | Polymer Coupler Latex | Monomer (Kind) | Coupler (Amount) | Nonchromophoric Monomer (Kind) | Nonchromophoric Monomer (Amount) | Monomer Coupler Units in Polymer (wt %) |
|---|---|---|---|---|---|---|
| 27 | C | C-2 | 20 g | BA | 20 g | 48.3 |
| 28 | D | C-5 | 20 g | MA | 25 g | 44.2 |
| 29 | E | C-5 | 20 g | EA | 25 g | 43.8 |
| 30 | F | C-16 | 20 g | MA | 20 g | 51.6 |
| 31 | G | C-18 | 20 g | BA | 20 g | 44.1 |
| 32 | | | | MAA | 5 g | |
| 33 | H | C-19 | 20 g | MA | 20 g | 52.6 |
| 34 | I | C-23 | 20 g | BA | 20 g | 50.3 |
| 35 | J | C-24 | 20 g | BA | 10 g | 67.2 |
| 36 | K | C-30 | 20 g | ST | 20 g | 48.6 |
| | | | | MAA | 5 g | |
| 37 | L | C-31 | 20 g | EA | 20 g | 50.9 |
| 38 | M | C-32 | 20 g | BA | 30 g | 40.2 |

Notes
The amounts of the monomer coupler and the monomer forming no color are set forth based on the amounts charged upon synthesis.
BA: n-butyl acrylate; MA: methyl acrylate; EA: ethyl acrylate; MAA: methacrylic acid; ST: styrene

PREPARATION EXAMPLE 39

Copolymer coupler of 6-methyl-3-[3-(methacrylamido)propyl]-1H-imidazo[1,2-b]-pyrazole ($C_p$-5) and butyl acrylate (Oleophilic polymer coupler (IP))

A mixture of 20 g of monomer coupler ($C_p$-5), 20 g of butyl acrylate and 200 ml of dioxane was heated to 80° C. with stirring in a nitrogen stream, then 20 ml of dioxane containing 0.5 g of dimethyl azobisisobutyrate was added thereto to initiate polymerization. After reacting for 5 hours, the reaction mixture was cooled, then added to 1.5 l of water, the separated solid was filtered off, and further washed thoroughly with water.

This solid was dried by heating under reduced pressure to obtain 38.5 g of oleophilic polymer (IP).

Chlorine analysis of this polymer coupler revealed that the formed copolymer contained 50.8% of monomer coupler ($C_p$-5).

Then, the method of dispersing Oleophilic polymer coupler (IP) in a gelatin aqueous solution in a latex form is now described. First, two solutions (a) and (b) were prepared as follows.

(a) 200 g of a 30 wt% aqueous solution of bone gelatin (pH 5.6 at 35° C.) was heated to 38° C., and 16 ml of a 10 wt% aqueous solution of sodium laurylsulfate was added thereto.

(b) 20 g of the aforesaid oleophilic polymer coupler (IP) was dissolved in 200 ml of ethyl acetate at 38° C.

Then, solution (b) was added to an explosion-proof mixer stirred at a high speed, and solution (a) was rapidly added thereto. After stirring for a minute, the mixer was stopped, and the ethyl acetate was removed by distillation under reduced pressure. Thus, the oleophilic polymer coupler was dispersed in a dilute gelatin solution to prepare latex (IP').

PREPARATION EXAMPLE 40

Copolymer coupler of 6-methyl-3-methacrylamido-1H-imidazo-[1,2-b]-pyrazole ($C_p$-2) and butyl acrylate (Oleophilic polymer coupler (IIP))

A mixture of 20 g of monomer coupler ($C_p$-2), 20 g of butyl acrylate and 200 ml of methyl cellosolve was heated to 80° C. with stirring in a nitrogen stream, then 20 ml of methyl cellosolve containing 0.5 g of dimethyl azobisisobutyrate was added thereto to initiate polymerization. After reacting for 5 hours, the reaction mixture was cooled, then added to 1.5 l of water, the separated solid was filtered off, and further thoroughly with water.

This solid was dried by heating under reduced pressure to obtan 39.0 g of oleophilic polymer (IIP).

Chlorine analysis of this polymer coupler revealed that the formed copolymer contained 51.2 g of monomer coupler ($C_p$-2).

Then, the method of dispersing oleophilic polymer coupler (IIP) in a gelatin aqueous solution in a latex form is now described. First, two solutions (a) and (b) were prepared as follows.

(a) 20 g of a 30 wt% aqueous solution of bone gelatin (pH 5.6 at 35° C.) was heated to 38° C., and 16 ml of a 10 wt% aqueous solution of sodium laurylsulfate was added thereto.

(b) 20 g of the aforesaid oleophilic polymer coupler (IIP) was dissolved in 200 ml of ethyl acetate at 38° C.

Then, solution (b) was added to an explosion-proof mixer stirred at a high speed, and solution (a) was rapidly added thereto. After stirring for a minute, the mixer was stopped, and the ethyl acetate was removed by distillation under reduced pressure. Thus, the oleophilic polymer coupler was dispersed in a dilute gelatin solution to prepare latex (IIP').

Then, the following oleophilic polymer couplers were prepared by the same procedures as in Preparation Examples 39 and 40.

Oleophilic Polymer Couplers by Preparation Process I

| Preparation Example | Oleophilic Polymer Coupler | Monomer (Kind) | Coupler (Amount) | Nonchromophoric Monomer (Kind) | Nonchromophoric Monomer (Amount) | Monomer Coupler Units in Polymer (wt %) |
|---|---|---|---|---|---|---|
| 41 | IIIP | Cp-1 | 20 g | BA | 20 g | 51.3 |
| 42 | IVP | Cp-3 | 20 g | MA | 20 g | 52.6 |
| 43 | VP | Cp-5 | 20 g | EHA | 30 g | 40.2 |
| 44 | VIP | Cp-9 | 20 g | BA | 20 g | 50.3 |
| 45 | VIIP | Cp-10 | 20 g | EA | 15 g | 59.7 |
| 46 | VIIIP | Cp-12 | 20 g | BA | 20 g | 51.0 |
| 47 | IXP | Cp-17 | 20 g | BA | 20 g | 51.3 |
| 48 | XP | Cp-18 | 20 g | BMA | 30 g | 41.6 |
| 49 | XIP | Cp-19 | 20 g | BA | 15 g | 50.5 |
| | | | | MAA | 5 g | |
| 50 | XIIP | Cp-20 | 20 g | BA | 20 g | 51.0 |
| 51 | XIIIP | Cp-23 | 20 g | BA | 15 g | 59.9 |
| 52 | XIVP | Cp-24 | 20 g | EA | 15 g | 60.3 |
| 53 | XVP | Cp-25 | 20 g | EHA | 20 g | 50.3 |
| 54 | XVIP | Cp-26 | 20 g | BA | 20 g | 51.5 |

Notes

MA: Methyl acrylate; BMA: Butyl methacrylate; EHA: 2-Ethylhexyl acrylate BA: Butyl acrylate; EA: Ethyl acrylate; MAA: Methacrylic acid The amounts of the monomer coupler and the nonchromophoric monomer each represents the amount charged at the time of synthesis.

These oleophilic polymer couplers may also be dispersed in a latex form similarly as in the above-described Preparation Examples 39 and 40.

(PREPARATION PROCESS II)

PREPARATION EXAMPLE 55

Copolymer latex of 6-methyl-3-acrylamido-1H-imidazo-[1,2-b]-pyrazole ($C_p$-1) with butyl acrylate and methacrylate acid (polymer latex coupler (A))

1.2 l of an aqueous solution containing 1 g of oleylmethyltauride in a 3-liter flask was heated to 80° C. with stirring while passing a nitrogen stream and, after adding 5 ml of a 2% aqueous solution of potassium persulfate to this aqueous solution, a solution of 20 g of monomer coupler ($C_p$-1), 15 g of butyl acrylate and 5 g of methacrylic acid dissolved by heating in 500 ml of methanol was added dropwise over 20 minutes.

After reacting for an hour, 5 ml of a 2% aqueous solution of potassium persulfate was added. After reacting for another hour, the methanol and water were distilled off.

The formed latex was cooled, then the latex solution was adjusted to pH 6.0 with 1N sodium hydroxide, and filtered.

The polymer concentration of the formed latex was found 4.8%, and nitrogen analysis revealed that the polymer contained 48.7% of monomer coupler ($C_p$-1).

The following copolymer coupler latexes were prepared by the same procedures as in Preparation Example 55.

Polymer Coupler Latexes by Preparation Process II

| Preparation Example | Polymer Coupler Latex | Monomer (Kind) | Coupler (Amount) | Nonchromophoric Monomer (Kind) | Nonchromophoric Monomer (Amount) | Monomer Coupler Units in Polymer (wt %) |
|---|---|---|---|---|---|---|
| 56 | Bp | Cp-2 | 20 g | BA | 20 g | 49.0 |
| 57 | Cp | Cp-5 | 20 g | EA | 20 g | 50.2 |
| 58 | Dp | Cp-5 | 20 g | BA | 15 g | 58.3 |
| 59 | Ep | Cp-9 | 20 g | BA | 20 g | 50.1 |
| 60 | Fp | Cp-12 | 20 g | MA | 30 g | 42.2 |
| 61 | Gp | Cp-15 | 20 g | BA | 20 g | 49.8 |
| 62 | Hp | Cp-17 | 20 g | EHA | 20 g | 49.6 |
| 63 | Ip | Cp-18 | 20 g | BA | 20 g | 50.2 |
| 64 | Jp | Cp-19 | 20 g | BA | 20 g | 50.5 |
| 65 | Kp | Cp-23 | 20 g | MA | 30 g | 42.6 |
| 66 | Lp | Cp-24 | 20 g | BA | 20 g | 50.3 |

-continued

| Polymer Coupler Latexes by Preparation Process II | | | | | | |
|---|---|---|---|---|---|---|
| Preparation Example | Polymer Coupler Latex | Monomer (Kind) | Coupler (Amount) | Nonchromophoric Monomer (Kind) | Nonchromophoric Monomer (Amount) | Monomer Coupler Units in Polymer (wt %) |
| 67 | Mp | Cp-25 | 20 g | BA | 20 g | 49.6 |

Note
The amounts of the monomer coupler and the nonchromophoric monomer each represents the amount charged at the time of synthesis.

The magenta polymer coupler latexes of the present invention may be used alone or in combinations of two or more.

The magenta polymer coupler latexes of the present invention may be used in combination with the magenta polymer coupler latexes as described in U.S. Pat. No. 4,080,211, British Pat. No. 1,247,688, etc.

In addition, the magenta polymer coupler latexes of the present invention may be loaded in a manner as described in Japanese Patent Application (OPI) No. 39853/76, with a dispersion of a hydrophobic magenta color-forming coupler as described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German OLS Nos. 2408665, 2417945, 2418959, 2424467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, etc. in a hydrophilic colloid, said dispersion being prepared according to a process as described in U.S. Pat. Nos. 2,269,158, 2,272,191, 2,304,940, 2,311,020, 2,322,027, 2,360,289, 2,772,163, 2,801,170, 2,801,171, 3,619,195, British Pat. No. 1,151,590, German Pat. No. 1,143,707, etc., or may be loaded with the above-described hydrophobic magenta couplers according to processes as described in Japanese Patent Application (OPI) Nos. 59942/76, 32552/79, U.S. Pat. No. 4,199,363, etc., for use. The term "load" as used herein means the state wherein the hydrophobic magenta coupler is within, or deposited on the surface of, the magenta polymer coupler latex particles. However, the mechanism as to how the loading takes place has not been fully clarified.

In order to obtain characteristic properties required for light-sensitive materials, the magenta polymer coupler latexes of the present invention may be loaded, in a manner as described in Japanese Patent Application (OPI) No. 39853/76, etc., with a dispersion of a development inhibitor-releasing (DIR) coupler described in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436, 3,808,945, British Pat. Nos. 1,201,110, 1,236,767, etc., in hydrophilic colloid, which dispersion is prepared according to a process as described in U.S. Pat. Nos. 2,269,158, 2,272,191, 2,304,940, 2,311,020, 2,322,027, 2,360,289, 2,772,163, 2,801,170 2,801,177 and 3,619,195, British Pat. No. 1,151,590, German Pat. No. 1,143,707, etc., or may be loaded with the above-described DIR couplers according to a process as described in Japanese Patent Application (OPI) Nos. 59942/76, 32552/79, U.S. Pat. No. 4,199,363, etc.

Further, DIR compounds as described in West German OLS Nos. 2529350, 2448063, 2610546, U.S. Pat. Nos. 3,043,690, 3,287,129, 3,297,445, 3,364,022, 3,379,529, 3,928,041, 3,958,993, 3,961,959, 4,049,455, 4,052,213, etc., may also be used in combination therewith.

Still further, the magenta polymer coupler latexes of the present invention may be used in combination with colored magenta couplers as described in U.S. Pat. No. 2,449,966, West German Pat. No. 2,024,186, Japanese Patent Application (OPI) Nos. 123625/74, 131448/74, 42121/77, etc., with competitive couplers as described in U.S. Pat. Nos. 3,876,428, 3,580,722, 2,998,314, 2,808,329, 2,742,832, 2,689,793, etc., stain-preventing agents as described in U.S. Pat. Nos. 2,336,327, 2,403,721, 2,701,197, 2,728,659, 3,700,453, etc., and dye image stabilizers as described in British Pat. No. 1,326,889, U.S. Pat. Nos. 3,432,300, 3,573,050, 3,574,627, 3,698,909, 3,764,337, etc.

In preparing photographic light-sensitive materials according to the present invention, well known couplers other than magenta-forming couplers may be used. As such couplers, non-diffusible couplers having a hydrophobic group called a ballast group are desirable. The couplers may be of either 4-equivalent type or 2-equivalent type. Colored couplers having color-correcting effects or couplers capable of releasing a development inhibitor upon development may also be used. These couplers may be couplers capable of forming a colorless coupling reaction product.

As yellow color-forming couplers, known open-chain ketomethylene couplers may be used. Of those, benzoylacetanilide type and pivaloylacetanilide type compounds are advantageous. Specific examples of usable yellow color-forming couplers are described in U.S. Pat. Nos. 2,875,057, 3,265,506, 3,408,194, 3,551,155, 3,582,322, 3,725,072, 3,891,445, West German Pat. No. 1,547,868, West German Application Nos. 2219917, 2261361, 2414006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, etc.

As cyan color-forming couplers, phenolic compounds, naphtholic compounds, etc., may be used. Specific examples thereof are described in U.S. Patents thereof are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application Nos. 2414830, 2454329, Japanese Patent Application (OPI) Nos. 59838/73, 26034/76, 5055/73, 146828/76, 73050/80, etc.

The above-described couplers may be used in combination of two or more in one layer, or the same compound may be used in two or more different layers.

The couplers are introduced into silver halide emulsion layers in a known manner described, for example, in U.S. Pat. No. 2,322,027, by dispersing in a hydrophilic colloid and mixing the resulting dispersion with a silver halide emulsion.

With couplers having an acid group such as a carboxylic acid or a sulfonic acid group, they are introduced into a hydrophilic colloid as an alkaline aqueous solution.

Silver halide emulsions to be used in the present invention comprise mixed silver halide such as silver chlorobromide, silver bromoiodide, silver chlorobromoiodide or the like as well as silver chloride or silver bromide, finely dispersed in a hydrophilic high polymer such as gelatin. The silver halide grains may have a uniform grain size or a wide grain size distribution, and may have a mean grain size falling within a range as wide as from about 0.1$\mu$ to about 3$\mu$, and proper grains may be selected depending upon the end-use of light-sensitive materials to be prepared. These silver halide emulsions may be subjected to chemical sensitization such as sulfur sensitization, gold sensitization, or reduction sensitization, and may contain sensitivity-enhancing agents such as polyoxyethylene compounds and onium compounds. Emulsions of the internal latent image type, which form latent images within silver halide grains, may be used in the present invention as well as emulsions of the type forming latent images mainly on the surfaces of the grains. In addition, two or more silver halide photographic emulsions separately prepared may be combined for use.

As the hydrophilic high molecular weight substance constituting the light-sensitive layer of the present invention, proteins such as gelatin, high molecular non-electrolytes such as polyvinyl alcohol, polyvinylpyrrolidone, polyacrylamide, etc., acidic high molecular substances such as algiantes, polyacrylic salts, etc., high molecular amphoteric electrolytes such as polyacrylamide processed according to Hofmann rearrangement reaction, acrylic acid-N-vinylimidazole copolymer, etc., cross-linkable polymers described in U.S. Pat. No. 4,215,195, etc., are suitable. These hydrophilic high molecular substances forming the continuous phase may contain dispersed hydrophobic high molecular substances such as latex of polybutyl acrylate, etc.

To the photographic emulsion of the present invention various compounds may be added for the purpose of preventing reduction of sensitivity and formation of fog in the steps of, or during storage or processing of, the light-sensitive materials. As such compounds, many compounds have long been known, such as many hetero ring compounds including 4-hydroxy-6-methyl-1,3,3a,7-tetrazaindene, 3-methylbenzothiazole, and 1-phenyl-5-mercaptotetrazole, mercury-containing compounds, mercapto compounds, metal salts, etc. Some usable examples thereof are described in *Research Disclosure,* 17643 (November, 1978), p. 24, VI "Antifoggant and Stabilizer".

Surfactants may be added, alone or in combination, to the photographic emulsion of the present invention. They are used as coating aids, but also, in some cases, for other purposes, such as improvement of emulsion dispersion, improvement of photographic sensitization properties, antistatic purpose, prevention of adhesion, etc.

The surfactants are grouped into: natural surfactants such as saponin; nonionic surfactants such as alkylene oxide derivatives, glycerin derivatives, glycidol derivatives, etc.; cationic surfactants such as higher alkylamines, quaternary ammonium salts, heterocyclic compounds (e.g., pyridine, etc.) phosphonium compounds, sulfonium compounds, etc.; anionic surfactants having an acidic group such as a carboxylic acid group, a sulfonic acid group, a phosphoric acid group, a sulfuric ester group or a phosphoric ester group; and amphoteric surfactants such as amino acids, aminosulfonic acids, aminoalcohol sulfuric or phosphoric esters, etc.

The photographic emulsions may be spectrally sensitized or super-sensitized with cyanine dyes such as cyanines, merocyanines, carbocyanines, etc., alone or in combination, or in further combination with styryl dyes, etc.

Such color sensitizing techniques have long been known and are described, for example, in U.S. Pat. Nos. 2,688,545, 2,912,329, 3,397,060, 3,615,635, 3,628,964, British Pat. Nos. 1,195,302, 1,242,588, 1,293,862, West German Patent OLS Nos. 2030326, 2121780, Japanese Patent Publication Nos. 4936/68, 14030/69, etc. An appropriate technique may be freely selected depending upon the desired end-use of light-sensitive material, wavelength region to be sensitized, sensitivity, etc.

The hydrophilic colloid layer of light-sensitive material to be used in the present invention, particularly gelatin layer, may be hardened with various crosslinking agents. For example, inorganic compounds such as chromium salts, zirconium salts, etc., and aldehyde compounds such as mucochloric acid or 2-phenoxy-3-chloromalealdehyde-acid described in Japanese Patent Publication No. 1872/71 are in many cases advantageous in the present invention. However, non-aldehyde type crosslinking agents such as compounds with a plurality of epoxy rings as described in Japanese Patent Publication No. 7133/59, poly(1-aziridinyl) compounds described in Japanese Patent Publication No. 8790/62, active halogen compounds in U.S. Pat. Nos. 3,362,827 and 3,325,287, and vinylsulfone type compounds as described in U.S. Pat. Nos. 2,994,611, 3,582,322, Belgian Pat. No. 686,440, etc., are particularly suited for the light-sensitive materials of the present invention.

The silver halide photographic emulsion of the present invention is typically positioned on a support. As the support, rigid supports such as glass, metal, porcelain, etc., and flexible supports can be used, according to the desired end-use of the photographic light-sensitive material. Typical flexible supports include a cellulose nitrate film, a cellulose acetate film, a polyvinyl acetal film, a polystyrene film, a polyethylene terephthalate film, a polycarbonate film, the laminate thereof, etc. Papers coated with baryta or $\alpha$-olefin polymer (particularly, polyethylene, polypropylene or ethylene-butene copolymer) and plastic films whose surface has been rendered rough as shown in Japanese Patent Publication No. 19068/72 can be also advantageously used. Proper supports can be selected from among transparent supports, colored supports containing dyes or pigments, supports opacified by adding titanium white or the like, supports containing light screens such as carbon black, and the like.

Each layer of the photographic light-sensitive material can be coated according to various coating methods including dip-coating method, air knife-coating method, curtain-coating method, and extrusion-coating method using a hopper described in U.S. Pat. No. 2,681,294. If necessary, two or more layers may be simultaneously coated according to methods as described in U.S. Pat. Nos. 2,761,791, 2,941,898, 3,508,947, 3,526,528, etc.

The light-sensitive material of the present invention can be of a so-called stratum structure type wherein emulsion layers different in color sensitivity and color-forming properties are coated one over the other on a support, or of a so-called mixed packet type wherein particulate emulsions different in color sensitivity and color-forming properties are coated as a mixture on a support. The light-sensitive material of the present invention can be in various forms such as color negative films, color positive films, color reversal films, color print papers, color reversal papers, etc.

In order to obtain dye images using the color photographic light-sensitive materials of the present invention, development processing is required after exposure. Development processing fundamentally involves a color developing step, a bleaching step, and a fixing step. Each step may be conducted independently, or two or more steps may be conducted in one step by using a processing solution having multiple functions. Also, each step may, if necessary, be conducted in two or more sub-steps. Furthermore, in addition to the above-described steps, the development processing may further involve, if necessary, a pre-hardening bath step, a neutralizing step, a first developing step (black-and-white development), a stabilizing step, a washing step, etc. Processing temperature is selected from the range preferable for a particular light-sensitive material and a particular development formulation, and, in general, is selected between 18° C. and 60° C. Additionally, temperatures for each of a series of the respective steps are not necessarily the same.

The color developing solution is an alkaline aqueous solution having a pH of 8 or more, and is preferably from 9 to 12, and contains a compound whose oxidation product can react with a color former, called, coupler, to form a colored product, i.e., a developing agent. The developing agent means a compound which has a primary amino group on an aromatic ring and which is capable of developing light-exposed silver halide, or a precursor capable of forming such compound. For example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfoamidoethyl-N,N-diethylaniline, the salts thereof (e.g., sulfates, hydrochlorides, sulfites, p-toluenesulfonates, etc.), etc., are typical preferable examples. Other examples are described in U.S. Pat. Nos. 2,193,015, 2,592,364, Japanese Patent Application (OPI) No. 64933/73, L. F. A. Mason, *Photographic Processing Chemistry* (Focal Press-London, 1966), pp. 226–229, T. H. James, *The Theory of the Photographic Process* (Macmillan, New York, 4th ed., 1977), pp. 315–320, etc. In addition, aminophenols as described in *The Theory of the Photographic Process* (4th ed.), pp. 311–315 may be used as well. Further, 3-pyrazolidones may be used together therewith.

Various additives may be added to the color developing solution as the occasion demands. Typical examples thereof include alkali agents (e.g., hydroxides, carbonates or phosphates of alkali metals or ammonium), pH-adjusting or buffering agents (e.g., weak acids such as acetic acid and boric acid, weak bases, salts thereof, etc.), development accelerators (e.g., various pyridinium compounds and cationic compounds as described in U.S. Pat. Nos. 2,648,684 3,671,247, etc., potassium nitrate, sodium nitrate, polyethyleneglycol or derivatives thereof as described in U.S. Pat. Nos. 2,533,990, 2,577,127, 2,950,970, etc., nonionic compounds such as polythioethers typically exemplified by those as described in British Pat. Nos. 1,020,032 and 1,020,033, polymer compounds having sulfite ester typically exemplified by the compounds as described in U.S. Pat. No. 3,068,097, organic amines (e.g., pyridine, ethanolamine, etc.), benzyl alcohol, hydrazines, etc.), antifogging agents (e.g., alkali bromides, alkali iodides, nitrobenzimidazoles described in U.S. Pat. Nos. 2,496,940 and 2,656,271, mercaptobenzimidazole, 5-methylbenzotriazole, 1-phenyl-5-mercaptotetrazole, compounds for rapid processing described in U.S. Pat. Nos. 3,113,864, 3,295,976, 3,342,596, 3,597,199, 3,615,522, etc., thiosulfonyl compounds as described in British Pat. No. 972,211, phenazine-N-oxides as described in Japanese Patent Publication No. 41675/71, and those described in *Kagaku Shashin Binran,* Vol. II, pp. 29–47), stain or sludge-preventing agents described in U.S. Pat. Nos. 3,161,513 and 3,161,514, British Pat. Nos. 1,030,442, 1,144,481, 1,251,558, etc., superimposed effect-accelerating agents as described in U.S. Pat. No. 3,536,487, etc., and known preservatives (e.g., sulfites, acid bisulfites, hydroxylamine hydrochloride, form-sulfite, alkanolamine-sulfite adducts, etc.).

The color photographic light-sensitive material of the present invention may be subjected to steps preceding the color development.

The first developing step for color reversal film is one of the steps preceding the color development. As the first developing solution, an alkaline aqueous solution containing one or more developing agents such as hydroquinone, 1-phenyl-3-pyrazolidone, N-methyl-p-aminophenol, etc., is used. In addition, the first developing solution contains a pH-adjusting or buffering agent such as an inorganic salt (e.g., sodium sulfate), borax, boric acid, sodium hydroxide or sodium carbonate, and development fog-preventing agents, such as alkali halide (e.g., potassium bromide).

The additives illustrated in each processing step and the amounts thereof to be added are well known in the field of color photographic processing.

After color development processing, color photographic materials are usually bleached and fixed. Bleaching and fixing may be combined using a bleach-fixing bath. As the bleaching agents, many compounds are used. Of them, ferricyanates, dichromates, water-soluble cobalt (III) salts, water-soluble iron (III) salts, water-soluble copper (II) salts, water-soluble quinones, nitrosophenols, and complex salts of polyvalent cations such as iron (III), cobalt (III), copper (II), etc., and organic acids, for example, metal complexes of aminopolycarboxylic acid (e.g., ethylenediaminetetraacetic acid, nitrilotriacetic acid, iminodiacetic acid, N-hydroxyethyl-ethylenediaminetriacetic acid, etc.), malonic acid, tartaric acid, malic acid, diglycollic acid, dithioglycollic acid, etc., and 2,6-dipicolinic acid-copper complex, peracids (e.g., alkyl peracids, persulfates, permanganates, hydrogen peroxide, hypochlorites, chlorine, bromine, bleaching powder, etc., are generally used either alone or in combination. To the processing solution may be further added various additives including bleaching accelerators as described in U.S. Pat. Nos. 3,042,520 and 3,241,966, Japanese Patent Publication Nos. 8506/70, 8836/70, etc.

For fixing, any of conventionally known fixing solutions may be used. That is, as fixing agents, ammonium, sodium or potassium thiosulfate is used in an amount of from about 50 to 200 g/liter. The fixing solution may further contain a stabilizing agent such as a sulfite, metabisulfite, etc., a hardener such as potash alum, a pH buffer such as acetate, borate, etc., and the like. The fixing solution has a pH of more than 3 or less than that.

As to the bleaching bath, fixing bath, and bleach-fixing bath, those techniques which are described in U.S. Pat. No. 3,582,322, Japanese Patent Application (OPI) No. 101934/73, German Pat. No. 1,051,117, etc., may also be applied.

The present invention will now be described in more detail by the following non-limiting examples of preferred embodiments of the present invention.

EXAMPLE 1

0.68 g (corresponding to 1.1 mmols) of coupler I of the present invention or 0.76 g (corresponding to 1.1 mmols) of a comparative coupler represented by the following chemical structural formula (a) was dissolved in a mixture of 20 ml of ethyl acetate and 10 ml of ethanol, and 1.3 mmols of a color developing agent, 4-N-ethyl-N-(2-methanesulfonamidoethyl)amino-2-methylaniline monosulfate, was suspended therein. Then, an aqueous solution of 12.9 mmols of anhydrous sodium carbonate in 5 ml of water was added thereto, followed by stirring the resulting solution at room temperature. 10 ml of an aqueous solution containing 2.4 mmols of potassium persulfate was gradually added dropwise to the mixture.

After stirring well at room temperature, 50 ml of ethyl acetate and 30 ml of water were added thereto to conduct extraction procedure. The ethyl acetate layer was washed well with a saturated sodium chloride aqueous solution, and the solvent was removed. The residue was subjected to column chromatography to separate the product. As the eluent, ethyl acetate/benzene (=1/1) was first used, then ethyl acetate/methanol (=1/1) to recover a polymer component.

Comparative coupler (a):

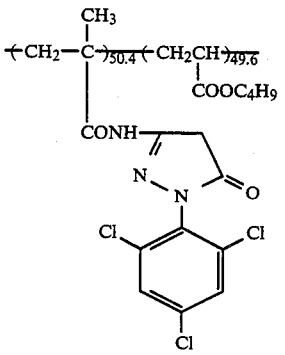

The visible absorption spectrum in ethyl acetate of magenta dye formed from polymer coupler I and that from comparative coupler (a) are shown in the FIGURE, with the maximum densities of the absorption spectra being standardized at 1.0 for comparison. In the FIGURE, the solid line shows the visible absorption spectrum of polymer coupler of the present invention, and the dashed line shows that of comparative polymer (a). As is seen from the FIGURE, the polymer coupler of the present invention does not show side absorption at around 400 to 430 nm, but does show a sharp decrease of absorption on the longer wave length side, thus being advantageous in view of color reproduction when used for color photographic light-sensitive materials.

EXAMPLE 2

To 13 g of polymer coupler I of the present invention or 8.7 g of polymer coupler V of the present invention were added 5 ml of trioctyl phosphate and 40 ml of ethyl acetate to dissolve. Then, each solution was added to 100 g of a 10% gelatin aqueous solution containing sodium di-secbutylnaphthylenesulfonate, followed by stirring and emulsifying in a homogenizer emulsifier to obtain emulsions. Each emulsion was mixed with 300 g (containing 13.5 g of silver) of a green-sensitive chlorobromide emulsion (Br: 45 mol%; Cl: 55 mol%). Then, a coating aid (sodium dodecylbenzenesulfonate) and a hardener (2-hydroxy-4,6-dichloro-s-triazine) were added thereto, and each of the resulting solutions was coated on a cellulose triacetate support. Further, a gelatin coating solution was coated thereon as a protective layer (1 g gelatin/$m^2$), followed by drying to prepare films A and B.

On the other hand, film C was prepared in the same manner as film A using 14.5 g of the comparative polymer coupler (a) as described in Example 1.

In addition, film D was prepared in the same manner as film A except for using 13 g of comparative coupler (b) represented by the following structural formula (b) and changing the amount of ethyl acetate to 15 ml and that of trioctyl phosphate to 15 ml.

Comparative coupler (b):

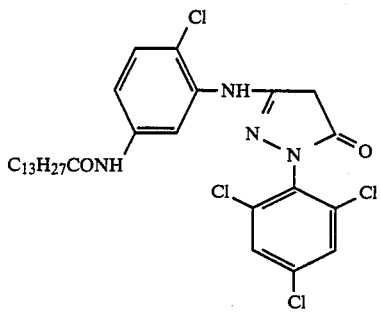

The thus prepared films A to D were exposed in an exposure amount of 1000 lux.sec using a sensitomer, and processed using the following processing solutions.

| Developing solution | |
|---|---|
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N—ethyl-N—β-(methanesulfonamido)ethylaniline $3/2H_2SO_4.H_2O$ | 4.5 g |
| Water to make | 1000 ml |
| pH | 10.1 |

| Bleach-fixing solution | |
|---|---|
| Ammonium thiosulfate (70 wt %) | 150 ml |
| $Na_2SO_3$ | 5 g |
| Na[Fe (EDTA)] | 40 g |
| EDTA | 4 g |
| Water to make | 1 liter |
| pH | 6.8 |

| Processing step | Temperature | Time |
|---|---|---|
| Developing solution | 33° C. | 3 min. & 30 sec. |
| Bleach-fixing soln. | 33° C. | 1 min. & 30 sec. |
| Washing with water | 28–35° C. | 3 min. |

Densities of dye images after the processing were measured using a Macbeth densitometer fitted with a status AA filter. Spectral absorption spectrum of each dye image was also measured. The results thus obtained are shown in Table 1. From Table 1, it is seen that the dye image on the film showed the desirable properties no side absorption and a sharp decrease in absorption on the longer wavelength side, as in Example 1. In addition, it is clear that the polymer couplers in accordance with the invention provide sufficiently good color density in comparison with the conventional 5-pyrazolone type coupler.

TABLE 1

| Film | Coupler | Maximum Density | Maximum Absorption Wavelength | $D_{420}$/Dmax |
|---|---|---|---|---|
| A | Coupler I* | 2.55 | 532 nm | 0.042 |
| B | Coupler V* | 2.60 | 535 nm | 0.045 |
| C | Coupler (a)** | 2.37 | 542 nm | 0.146 |
| D | Coupler (b)** | 2.62 | 535 nm | 0.137 |

*present invention;
**comparison

EXAMPLE 3

Two magenta dyes were obtained from color-formed polymer (IP) and comparison coupler (a) respectively, the former being prepared by procedures similar to those in Example 1 except that the Coupler (I) was replaced by 0.70 g (corresponding to 1.1 mmol) of coupler (IP).

The characteristics of visible light absorption spectra of these two magenta dyes in ethyl acetate are shown in Table 2.

TABLE 2

| Coupler | Maximum Absorption Wavelength | $OD_{420nm}/OD_{\lambda max}$ | $OD_{\lambda max+60nm}/OD_{\lambda max}$ |
|---|---|---|---|
| Polymer Coupler (I) | 516 nm | 0.04 | 0.05 |
| Comparison Coupler (a) | 528 nm | 0.20 | 0.22 |

As shown in Table 2, the polymer coupler of this invention has no side absorption in the vicinity of 400 nm to 430 nm and the tail on the long wavelength side ends sharply, thus advantageous for color reproduction when used in a color photographic photosensitive material.

EXAMPLE 4

Films E and F were obtained by similar procedures to those in Example 2 for obtaining Films A and B except that the polymer coupler (I) and the polymer coupler (II) were replaced by 13 g of polymer coupler (IP) and 8.7 g of polymer coupler (IIP) respectively.

Then, Films G and H were also freshly prepared using the comparison couplers (a) and (b) same as in Example 2.

The above Films E to H were exposed and developed similarly as in Example 2 to obtain each dye image and measured for the maximum density and absorption characteristics, the results of which are summarized in Table 3.

Both polymer couplers (IP) and (IIP) of this invention has only little yellow side absorption and sharp decrease in absorption on the longer wavelength side, and gave an adequate color-forming concentration as compared with the conventional 5-pyrazolone type coupler.

TABLE 3

| Film | Coupler | Maximum Density | Maximum Absorption Wavelength | $D_{420}$/Dmax |
|---|---|---|---|---|
| E | Coupler IP* | 2.57 | 531 nm | 0.040 |
| F | Coupler IIP* | 2.61 | 533 nm | 0.046 |
| G | Coupler (a)** | 2.35 | 543 nm | 0.140 |
| H | Coupler (b)** | 2.60 | 536 nm | 0.132 |

*present invention;
**comparison

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing in its silver halide emulsion layer a magenta color image-forming polymer or copolymer coupler capable of coupling with an oxidation product of an aromatic primary amine developing agent, wherein said coupler has repeating units derived from the monomer represented by formula (I), (II), (III), (IV) or (V)

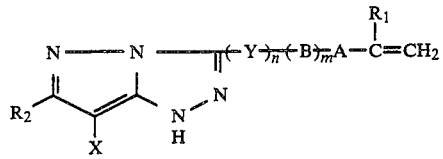
(I)

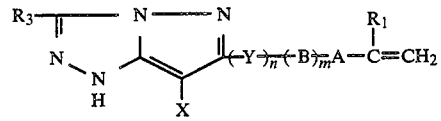
(II)

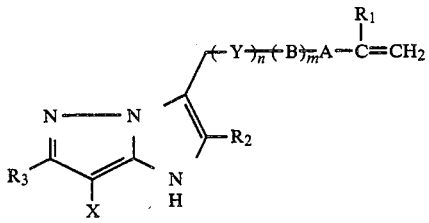
(III)

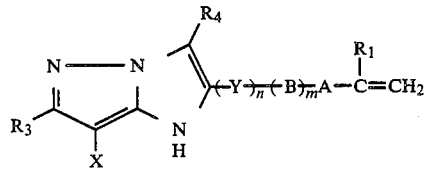
(IV)

-continued (V)

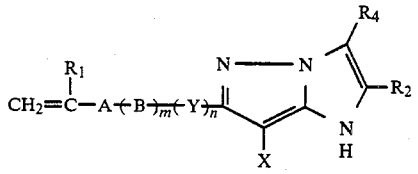

wherein $R_1$ represents a hydrogen atom, a lower alkyl group containing 1 to 4 carbon atoms or a chlorine atom, $R_2$, $R_3$ and $R_4$ each represents a hydrogen atom, a hydroxy group, a substituted or unsubstituted alkyl group, a substituted or unsubstituted aryl group, a substituted or unsubstituted 5- or 6-membered hetero ring group, a substituted or unsubstituted alkylamino group, a substituted or unsubstituted acylamino group, a substituted or unsubstituted anilino group, a substituted or unsubstituted alkoxycarbonyl group, a substituted or unsubstituted alkylcarbonyl group, a substituted or unsubstituted arylcarbonyl group, a substituted or unsubstituted alkylthio group, a substituted or unsubstituted arylthio group, a substituted or unsubstituted carbamoyl group, a substituted or unsubstituted sulfamoyl group of a substituted or unsubstituted sulfonamido group, X represents a hydrogen atom, a halogen atom, or a coupling-off group linked through an oxygen atom, nitrogen atom or sulfur atom, A represents —NHCO—, —OCO— or a phenylene group, B represents a substituted or unsubstituted alkylene (straight or branched), substituted or unsubstituted aralkylene or a substituted or unsubstituted phenylene group, Y represents —O—, —NH—, —S—, —SO—, —$SO_2$—, —CONH—, —COO—, —NHCO— or —NHCONH—, and m represents 1 when n represents 1, or m represents 0 or 1 when n represents 0.

2. A silver halide color photographic light-sensitive material as in claim 1, wherein $R_1$ represents a hydrogen atom or a lower alkyl group, $R_2$, $R_3$ and $R_4$ each represents a hydrogen atom, an alkyl group, or an aryl group, X represents a hydrogen atom, a halogen atom or a coupling-off group linked through a nitrogen atom, and when n=1, Y represents —NHCO—, and, when m=1, B represents an unsubstituted alkylene, aralkylene, or phenylene group and A represents —NHCO—.

3. A silver halide color photographic light-sensitive material as in claim 1, wherein the copolymer of the magenta color image-forming polymer is an ethylenically unsaturated monomer which does not couple with an oxidation product of an aromatic primary amine developing agent.

4. A silver halide color photographic light-sensitive material as in claim 2, wherein the copolymer of the magenta color image-forming polymer is an ethylenically unsaturated monomer which does not couple with an oxidation product of an aromatic primary amine developing agent.

5. A silver halide color photographic light-sensitive material as in claim 3, wherein the copolymer is formed using a copolymer selected from the group consisting of acrylic esters, methacrylic esters, and maleic esters.

6. A silver halide color photographic light-sensitive material as in claim 4, wherein the copolymer is formed using a copolymer selected from the group consisting of acrylic esters, methacrylic esters, and maleic esters.

7. A silver halide color photographic light-sensitive materials as in claim 1, wherein the coupler comprises from 5 to 80 wt% of a color-forming moiety corresponding to (I), (II), (III), (IV) or (V).

8. A silver halide color photographic light-sensitive materials as in claim 2, wherein the coupler comprises from 5 to 80 wt% of a color-forming moiety corresponding to (I), (II), (III), (IV) or (V).

9. A silver halide color photographic light-sensitive materials as in claim 3, wherein the coupler comprises from 5 to 80 wt% of a color-forming moiety corresponding to (I), (II), (III), (IV) or (V).

10. A silver halide color photographic light-sensitive materials as in claim 4, wherein the coupler comprises from 5 to 80 wt% of a color-forming moiety corresponding to (I), (II), (III), (IV) or (V).

11. A silver halide color photographic light-sensitive materials as in claim 5, wherein the coupler comprises from 5 to 80 wt% of a color-forming moiety corresponding to (I), (II), (III), (IV) or (V).

12. A silver halide color photographic light-sensitive materials as in claim 6, wherein the coupler comprises from 5 to 80 wt% of a color-forming moiety corresponding to (I), (II), (III), (IV) or (V).

13. A silver halide color photographic light-sensitive materials as in claim 1, wherein the coupler comprises from 20 to 70 wt% of a color-forming moiety corresponding to (I), (II), (III), (IV) or (V).

14. A silver halide color photographic light-sensitive materials as in claim 2, wherein the coupler comprises from 20 to 70 wt% of a color-forming moiety corresponding to (I), (II), (III), (IV) or (V).

15. A silver halide color photographic light-sensitive materials as in claim 3, wherein the coupler comprises from 20 to 70 wt% of a color-forming moiety corresponding to (I), (II), (III), (IV) or (V).

16. A silver halide color photographic light-sensitive materials as in claim 4, wherein the coupler comprises from 20 to 70 wt% of a color-forming moiety corresponding to (I), (II), (III), (IV) or (V).

17. A silver halide color photographic light-sensitive materials as in claim 5, wherein the coupler comprises from 20 to 70 wt% of a color-forming moiety corresponding to (I), (II), (III), (IV) or (V).

18. A silver halide color photographic light-sensitive materials as in claim 6, wherein the coupler comprises from 20 to 70 wt% of a color-forming moiety corresponding to (I), (II), (III), (IV) or (V).

* * * * *